US011552420B2

(12) United States Patent
Obata et al.

(10) Patent No.: US 11,552,420 B2
(45) Date of Patent: Jan. 10, 2023

(54) FLOATING CONNECTOR

(71) Applicant: JAPAN AVIATION ELECTRONICS INDUSTRY, LIMITED, Tokyo (JP)

(72) Inventors: Yusuke Obata, Tokyo (JP); Takashi Tokunaga, Tokyo (JP); Kiichi Hori, Tokyo (JP); Kazuki Takikawa, Tokyo (JP); Hiroaki Obikane, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/243,793

(22) Filed: Apr. 29, 2021

(65) Prior Publication Data

US 2022/0021143 A1 Jan. 20, 2022

(30) Foreign Application Priority Data

Jul. 15, 2020 (JP) ..... JP2020-121509

(51) Int. Cl.
*H01R 13/631* (2006.01)
*H01R 12/91* (2011.01)
(Continued)

(52) U.S. Cl.
CPC ..... *H01R 12/91* (2013.01); *H01R 12/7005* (2013.01); *H01R 12/716* (2013.01);
(Continued)

(58) Field of Classification Search
CPC .. H01R 12/91; H01R 12/7005; H01R 12/716; H01R 13/04; H01R 13/10; H01R 13/502;
(Continued)

(56) References Cited

U.S. PATENT DOCUMENTS 9,178,326 B2 * 11/2015 Funayama ..... H01R 12/91
10,608,361 B2 3/2020 Teruki
(Continued)

FOREIGN PATENT DOCUMENTS

JP H0817526 B2 3/1989
JP 2018116825 A 7/2018
(Continued)

OTHER PUBLICATIONS

Extended European Search Report (EESR) dated Oct. 27, 2021, issued in European Application No. 21172912.4.
(Continued)

*Primary Examiner* — Abdullah A Riyami
*Assistant Examiner* — Nelson R. Burgos-Guntin
(74) *Attorney, Agent, or Firm* — Holtz, Holtz & Volek PC

(57) ABSTRACT

A floating connector comprises a movable housing, a regulating member and a plurality of contacts. Each of the contacts is made of a single metal plate. Each of the contacts has a fixed portion, a regulated portion, a held portion, an extending portion, a contact portion and a coupling portion. The coupling portion is resiliently deformable. The movable housing is movable within a predetermined range in a plane perpendicular to an up-down direction by the resilient deformation of the coupling portion. The coupling portion has a first portion, a second portion and a bent portion. Each of the first portion and second portion has a principal surface. The principal surface of the first portion faces in a first direction. The principal surface of the second portion faces in a second direction. The first direction and the second direction are different from each other.

11 Claims, 20 Drawing Sheets

(51) Int. Cl.

| | |
|---|---|
| ***H01R 12/70*** | (2011.01) |
| ***H01R 12/71*** | (2011.01) |
| ***H01R 13/04*** | (2006.01) |
| ***H01R 13/10*** | (2006.01) |
| ***H01R 13/502*** | (2006.01) |

(52) U.S. Cl.
CPC ..... *H01R 13/04* (2013.01); *H01R 13/10* (2013.01); *H01R 13/502* (2013.01)

(58) Field of Classification Search
CPC .. H01R 12/707; H01R 13/6474; H01R 12/55; H01R 13/2442; H01R 13/02; H01R 13/05; H01R 13/11
See application file for complete search history.

(56) References Cited

U.S. PATENT DOCUMENTS

| | | | | |
|---|---|---|---|---|
| 10,804,630 | B2 | 10/2020 | Horii | |
| 10,950,978 | B2 * | 3/2021 | Shioda | H01R 13/112 |
| 2018/0337482 | A1 * | 11/2018 | Teruki | H01R 13/506 |

FOREIGN PATENT DOCUMENTS

| | | | |
|---|---|---|---|
| JP | 2018195567 | A | 12/2018 |
| JP | 2019079816 | A | 5/2019 |
| JP | 2019192527 | A | 10/2019 |
| JP | 6629417 | B2 | 12/2019 |
| TW | M593671 | U | 4/2020 |

OTHER PUBLICATIONS

Taiwanese Office Action dated May 18, 2022 (and English translation thereof) issued in counterpart Taiwanese Application No. 110115273.
European Office Action dated Apr. 5, 2022, issued in counterpart European Application No. 21172912.4.

* cited by examiner

FLOATING CONNECTOR

CROSS REFERENCE TO RELATED APPLICATIONS

This application is based on and claims priority under 35 U.S.C. § 119 to Japanese Patent Application No. JP2020-121509 filed Jul. 15, 2020, the contents of which are incorporated herein in their entirety by reference.

BACKGROUND OF THE INVENTION

This invention relates to a floating connector used in a state where the floating connector is mounted on a circuit board.

As shown in FIG. 36, JPA2018-116825 (Patent Document 1) discloses a floating connector 900 of this type. As shown in FIGS. 36 and 37, the floating connector 900 comprises a movable housing 920, a fixed housing main 910, or a regulating member 910, and a plurality of contacts 950. The movable housing 920 has second holding portions 922, or holding portions 922. The regulating member 910 has first holding portions 912, or regulating portions 912. Each of the contacts 950 is formed by punching out a blank from a metal plate and bending the blank. Each of the contacts 950 has a fixed portion 952, a first held portion 954, or a regulated portion 954, a second held portion 956, or a held portion 956, an extending portion 958, a contact portion 959 and a coupling portion 957. The fixed portion 952 is configured to be fixed to a circuit board (not shown). A movement of the regulated portion 954 in a pitch direction, or in a Y-direction, is regulated by the regulating portion 912. The held portion 956 is held by the holding portion 922. The extending portion 958 extends upward from the held portion 956. The contact portion 959 is supported by the extending portion 958. The coupling portion 957 couples the regulated portion 954 and the held portion 956 with each other. The contact portion 959 is brought into contact with a mating contact portion (not shown) when the floating connector 900 is mated with a mating connector (not shown). The coupling portion 957 is resiliently deformable. The movable housing 920 is movable relative to the regulating member 910 at least in a horizontal direction, or in an X-direction, by the resilient deformation of the coupling portion 957.

When a movable housing is moved in a pitch direction in a floating connector, similar to the floating connector 950 of Patent Document 1, which comprises a contact 950 formed by punching out a blank from a metal plate and bending the blank, torsional stress might occur in a held portion of the contact so that a problem might arise in the contact.

SUMMARY OF THE INVENTION

It is therefore an object of the present invention to provide a floating connector which can suppress occurrence of torsional stress in a held portion of a contact even when a movable housing is moved in a pitch direction.

One aspect of the present invention provides a floating connector used in a state where the floating connector is mounted on a circuit board. The floating connector is mateable with and removable from a mating connector along an up-down direction. The mating connector has a mating contact portion. The floating connector comprises a movable housing, a regulating member and a plurality of contacts. The movable housing has a holding portion. The regulating member has a regulating portion. Each of the contacts is made of a single metal plate. Each of the contacts has a fixed portion, a regulated portion, a held portion, an extending portion, a contact portion and a coupling portion. The fixed portion is configured to be fixed to the circuit board. A movement of the regulated portion in a pitch direction perpendicular to the up-down direction is regulated by the regulating portion. The held portion is held by the holding portion. The extending portion extends upward in the up-down direction from the held portion. The contact portion is supported by the extending portion. The coupling portion couples the regulated portion and the held portion with each other. The contact portion is brought into contact with the mating contact portion when the floating connector is mated with the mating connector. The coupling portion is resiliently deformable. The movable housing is movable within a predetermined range in a plane perpendicular to the up-down direction by the resilient deformation of the coupling portion. The coupling portion has a first portion, a second portion and a bent portion. Each of the first portion and second portion has a principal surface. The bent portion connects the first portion and the second portion with each other. The first portion is positioned between the held portion and the bent portion. The second portion is positioned between the regulated portion and the bent portion. The principal surface of the first portion faces in a first direction. The principal surface of the second portion faces in a second direction. The first direction and the second direction are different from each other.

The floating connector of the present invention is configured as follows: each of the contacts is made of the single metal plate; each of the contacts has the regulated portion, the held portion and the coupling portion which couples the regulated portion and the held portion with each other; the coupling portion has the first portion, the second portion and the bent portion which connects the first portion and the second portion with each other; and the first direction and the second direction are different from each other. In other words, the contact of the floating connector of the present invention is provided with the first portion and the second portion whose thickness directions, which are directions in which they are resiliently deformable mainly, are different from each other. Accordingly, the floating connector of the present invention is configured so that, when the movable housing is moved in a movement direction, one of the first portion and the second portion that is easier to be resiliently deformed in response to the movement direction of the movable housing is resiliently deformed. By this configuration, the floating connector of the present invention can suppress occurrence of torsional stress in the held portion of the contact even when the movable housing is moved in the pitch direction.

An appreciation of the objectives of the present invention and a more complete understanding of its structure may be had by studying the following description of the preferred embodiment and by referring to the accompanying drawings.

Figure 1:
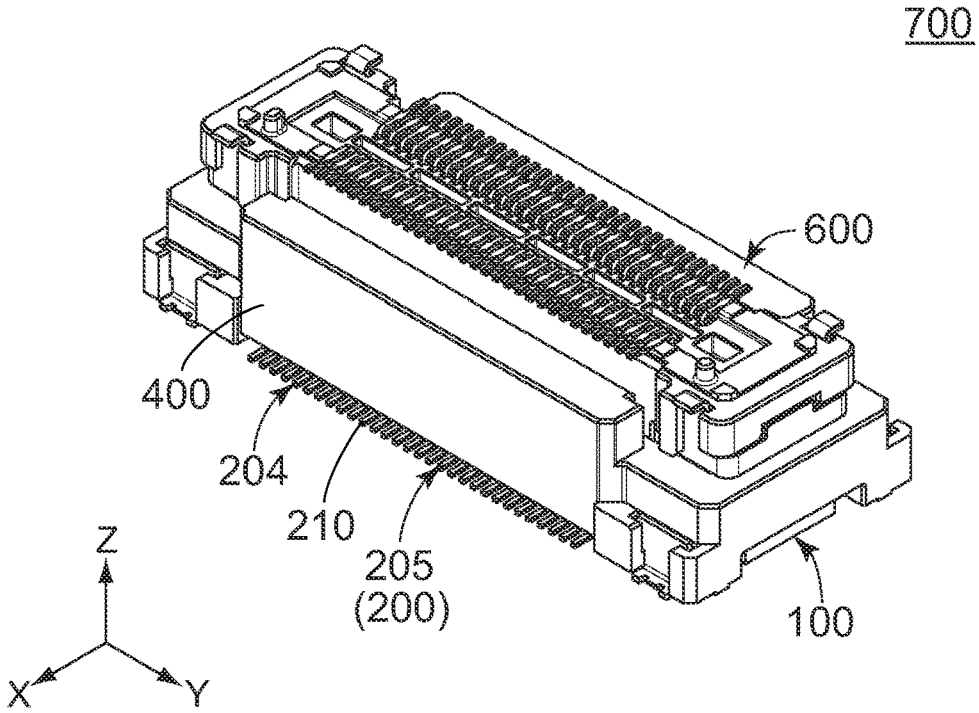
FIG. 1 is a perspective view showing a connector assembly according to a first embodiment of the present invention. In the figure, a floating connector and a mating connector are in a mated state where the floating connector and the mating connector are mated with each other.
Figure 2:
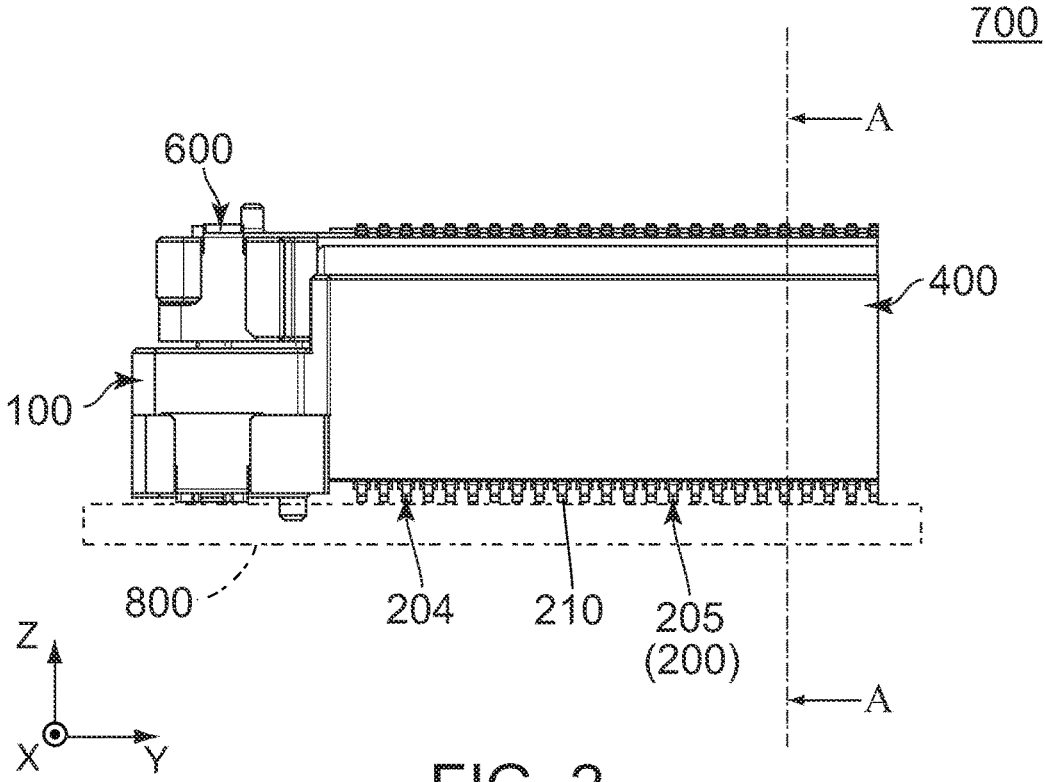
FIG. 2 is a front view showing the connector assembly of FIG. 1. In the figure, a circuit board is illustrated by dotted line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 4:
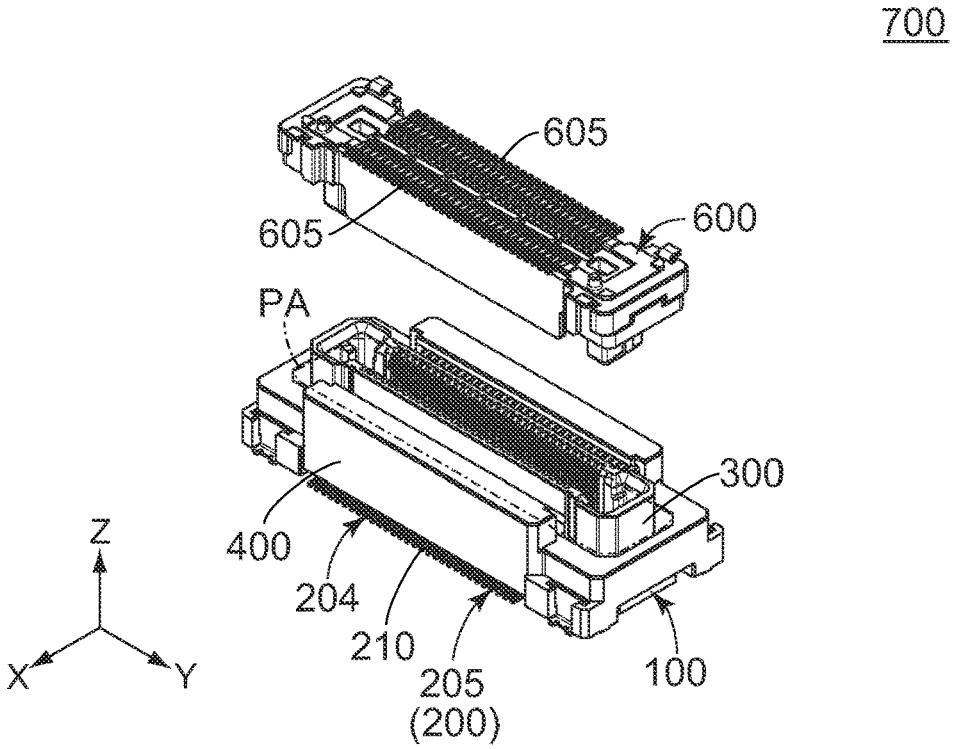
FIG. 4 is another perspective view showing the connector assembly of FIG. 1. In the figure, the floating connector and the mating connector are in an unmated state where the floating connector and the mating connector are unmated with each other.
Figure 5:
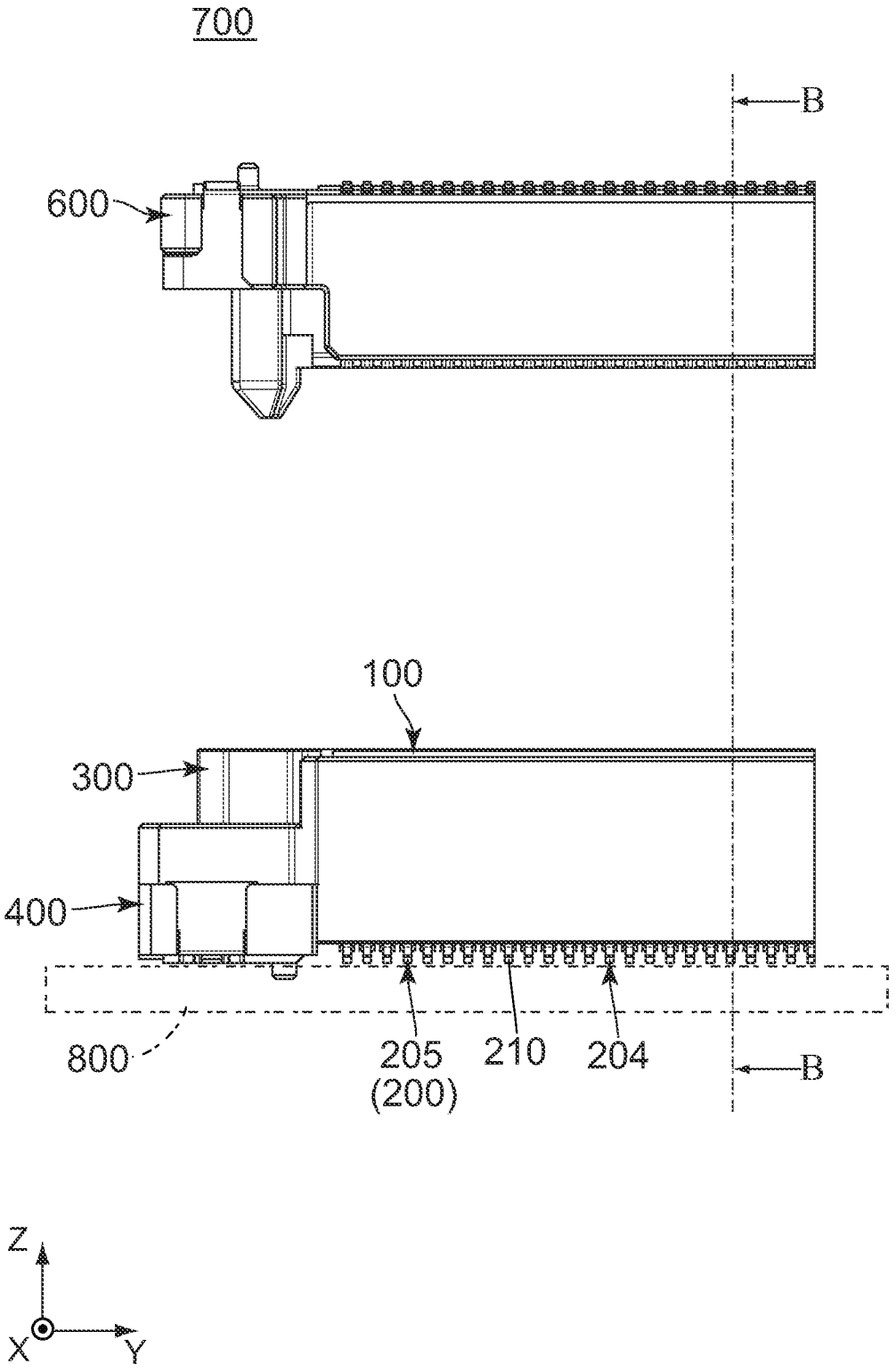
FIG. 5 is a front view showing a part of the connector assembly of FIG. 4. In the figure, the circuit board is illustrated by dotted line.

As shown in FIG. 4, a connector assembly 700 according to a first embodiment of the present invention comprises a mating connector 600 and a floating connector 100.

Figure 6:
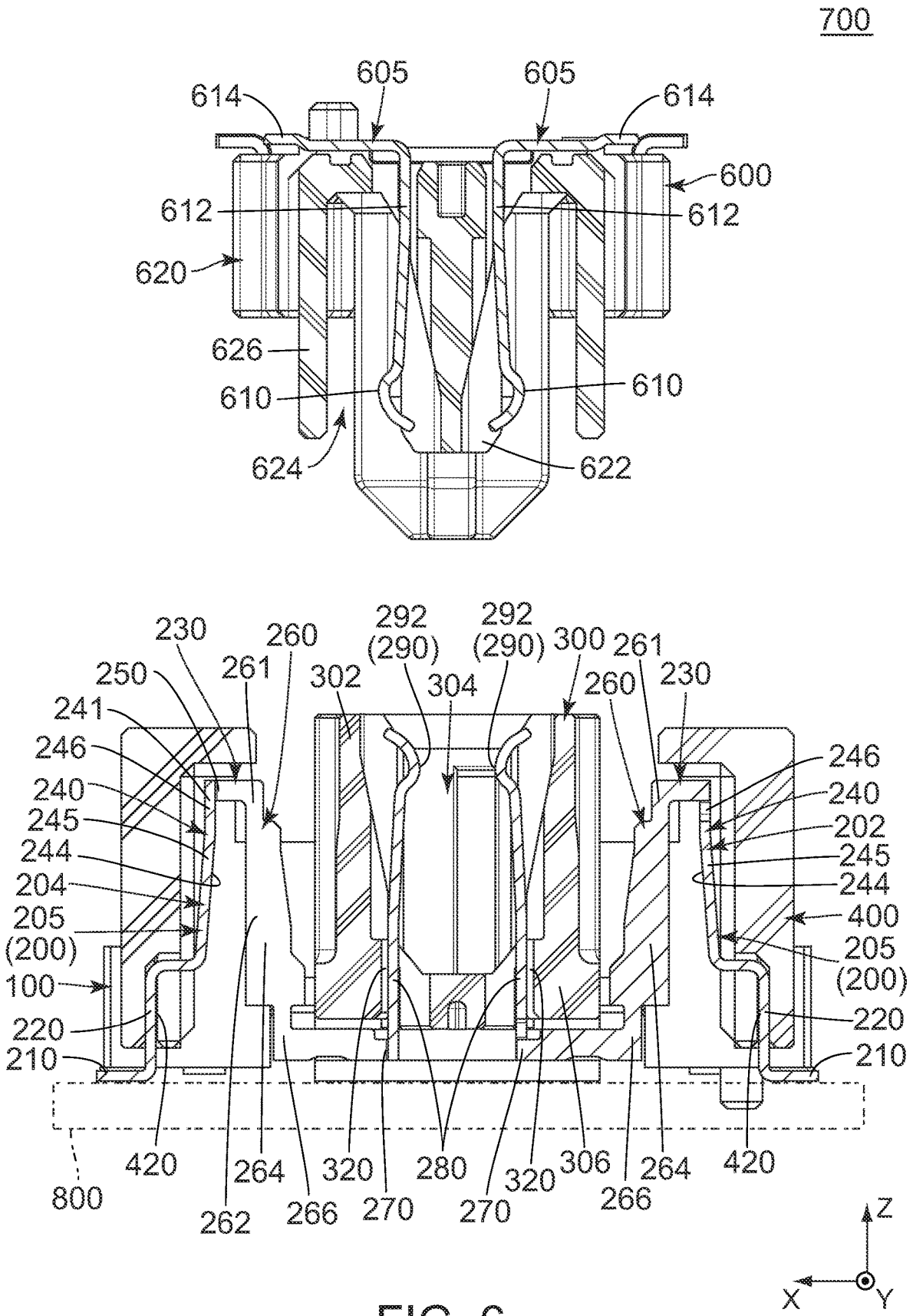
FIG. 6 is a cross-sectional view showing the connector assembly of FIG. 5, taken along line B-B. In the figure, the circuit board is illustrated by dotted line.

As shown in FIG. 6, the mating connector 600 of the present embodiment has a mating housing 620 and a plurality of mating contacts 605.

Referring to FIG. 6, the mating housing 620 of the present embodiment is made of insulator. The mating housing 620 has a protruding portion 622, a movable housing accommodating portion 624 and a mating surrounding portion 626.

As shown in FIG. 6, the protruding portion 622 of the present embodiment protrudes downward in an up-down direction. The protruding portion 622 is surrounded by the mating surrounding portion 626 in a plane perpendicular to the up-down direction. The protruding portion 622 is surrounded by the movable housing accommodating portion 624 in the plane perpendicular to the up-down direction. In the present embodiment, the up-down direction is a Z-direction. Specifically, it is assumed that upward is a positive Z-direction while downward is a negative Z-direction. In the present embodiment, the plane perpendicular to the up-down direction is an XY-plane.

As shown in FIG. 6, the movable housing accommodating portion 624 of the present embodiment is opened downward in the up-down direction. The movable housing accommodating portion 624 is a space extending in the up-down direction. The movable housing accommodating portion 624 is surrounded by the mating surrounding portion 626 in the plane perpendicular to the up-down direction.

As shown in FIG. 6, the mating surrounding portion 626 of the present embodiment surrounds the protruding portion 622 in the plane perpendicular to the up-down direction. The mating surrounding portion 626 surrounds the movable housing accommodating portion 624 in the plane perpendicular to the up-down direction.

As shown in FIG. 4, the mating contacts 605 of the present embodiment are arranged in two rows in a horizontal direction perpendicular to the up-down direction. In the present embodiment, the horizontal direction is an X-direction. The horizontal direction is also a front-rear direction. Specifically, it is assumed that forward is a positive X-direction while rearward is a negative X-direction. The mating contacts 605 of each row are arranged in a pitch direction perpendicular to the up-down direction and the horizontal direction. In the present embodiment, the pitch direction is a Y-direction.

As shown in FIG. 6, the mating contacts 605 are held by the mating housing 620. More specifically, the mating contacts 605 are held by the protruding portion 622. In the movable housing accommodating portion 624, a part of the mating contact 605 is exposed to the outside of the protruding portion 622 from a side surface of the protruding portion 622 in the horizontal direction. Each of the mating contacts 605 is made of metal. Each of the mating contacts 605 has a mating contact portion 610, a mating extending portion 612 and a mating fixed portion 614. In other words, the mating connector 600 has the mating contact portions 610.

As shown in FIG. 6, the mating contact portion 610 of the present embodiment faces outward in the horizontal direction. In the movable housing accommodating portion 624, the mating contact portion 610 is exposed to the outside of the protruding portion 622 from the side surface of the protruding portion 622 in the horizontal direction. The mating contact portion 610 is formed of a roll surface of a base metal plate. In other words, the mating contact portion 610 is not a rough, broken face of a base metal plate.

As shown in FIG. 6, the mating extending portion 612 of the present embodiment extends in the up-down direction. The mating extending portion 612 supports the mating contact portion 610.

As shown in FIG. 6, the mating fixed portion 614 of the present embodiment extends outward in the horizontal direction from the mating extending portion 612. The mating fixed portion 614 defines an upper end of the mating contact 605 in the up-down direction. The mating fixed portion 614 defines an outer end of the mating contact 605 in the horizontal direction.

Figure 3:
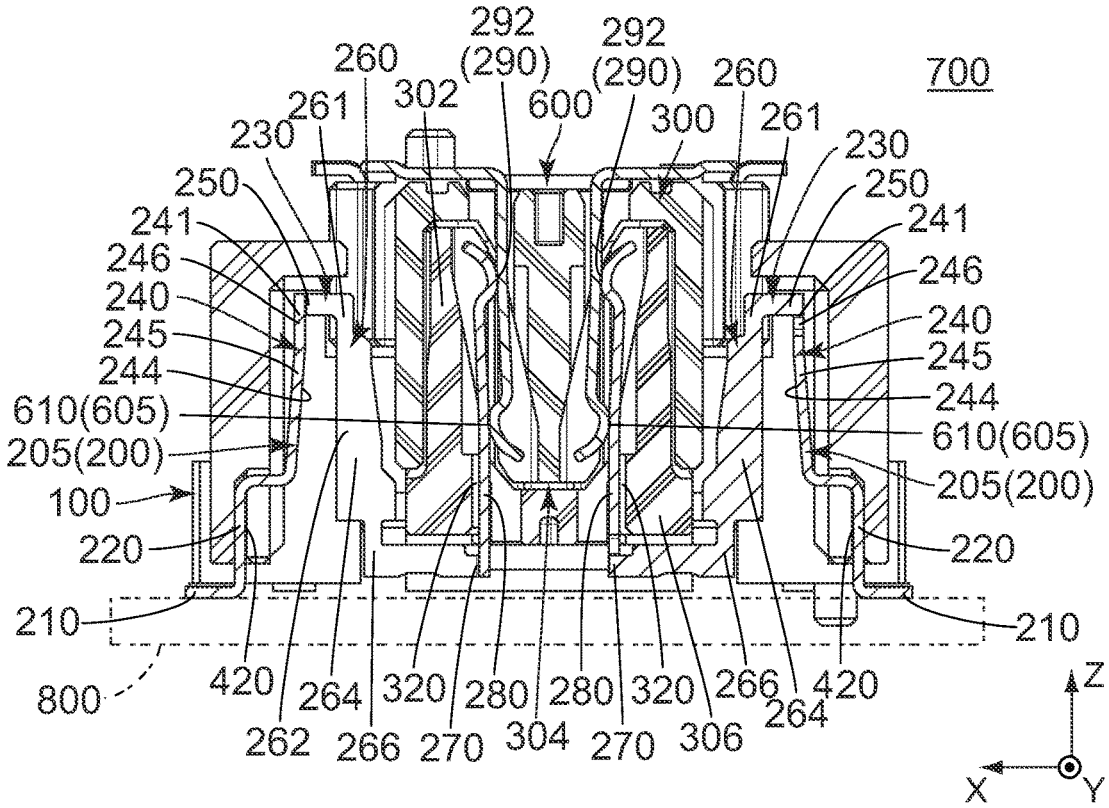
FIG. 3 is a cross-sectional view showing the connector assembly of FIG. 2, taken along line A-A. In the figure, the circuit board is illustrated by dotted line.

As shown in FIGS. 3 and 6, the floating connector 100 of the present embodiment is used in a state where the floating connector 100 is mounted on a circuit board 800. In addition, the floating connector 100 is mateable with and removable from the mating connector 600 having the mating contact portions 610 along the up-down direction.

As shown in FIG. 6, the floating connector 100 of the present embodiment has a movable housing 300, a regulating member 400 and a plurality of contacts 200.

Referring to FIG. 6, the movable housing 300 of the present embodiment is made of insulator. The movable housing 300 has a surrounding portion 302, an accommodating portion 304 and a bottom portion 306.

As shown in FIG. 6, the surrounding portion 302 of the present embodiment has a substantially rectangular tube shape extending in the up-down direction.

As shown in FIG. 6, the accommodating portion 304 of the present embodiment is opened upward in the up-down direction. The accommodating portion 304 is surrounded by the surrounding portion 302 in the plane perpendicular to the up-down direction. As understood from FIGS. 3 and 6, the accommodating portion 304 accommodates the protruding portion 622 of the mating connector 600 when the floating connector 100 and the mating connector 600 are mated with each other.

As shown in FIG. 6, the bottom portion 306 of the present embodiment is positioned below the accommodating portion 304 in the up-down direction. The bottom portion 306 defines a lower end of the movable housing 300 in the up-down direction. The bottom portion 306 has a plurality of holding portions 320. In other words, the movable housing 300 has the holding portions 320.

Referring to FIG. 6, each of the holding portions 320 of the present embodiment is a set of two ditches each extending in the up-down direction. The holding portions 320 correspond to the contacts 200, respectively. Each of the ditches of the holding portion 320 has an inner wall facing inward in the pitch direction.

Referring to FIG. 6, the regulating member 400 of the present embodiment is made of insulator. The regulating member 400 extends in the up-down direction. The regulating member 400 has a plurality of regulating portions 420.

Referring to FIG. 6, the regulating portions 420 of the present embodiment correspond to the contacts 200, respectively. Each of the regulating portions 420 is a ditch which is provided to the regulating member 400. Each of the regulating portions 420 is positioned in the vicinity of an outer end of the regulating member 400 in the horizontal direction. Each of the regulating portions 420 has two inner walls each facing inward in the pitch direction.

Figure 7:
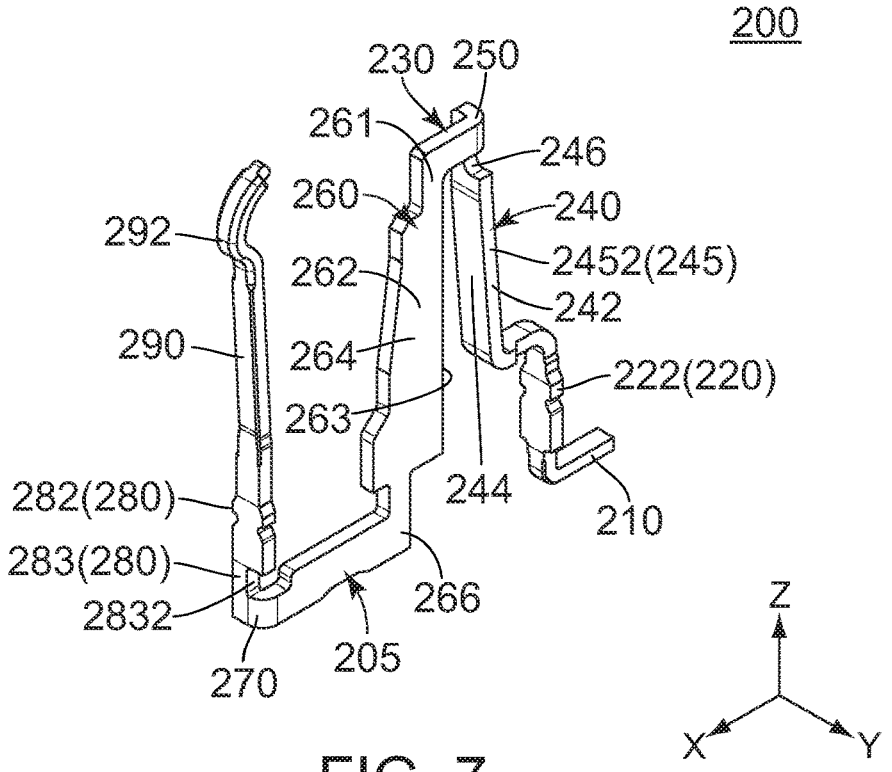
FIG. 7 is an upper, perspective view showing a contact included in the floating connector of the connector assembly of FIG. 4.

Referring to FIG. 7, each of the contacts 200 of the present embodiment is made of a single metal plate 205. The contact 200 is a so-called bent contact. Referring to FIG. 6, the contacts 200 form two contact rows 202, 204. The two contact rows 202, 204 are arranged in the horizontal direction. The contacts 200 of each of the contact rows 202, 204 are arranged in the pitch direction. The contact row 202 is positioned rearward of the contact row 204 in the front-rear direction, or in the horizontal direction.

Hereinafter, explanation will be made about the contact 200 included in the contact row 202 as shown in FIG. 6. The contact 200, which is included in the contact row 204 as shown in FIG. 6, has a structure same as that of the contact 200, which is included in the contact row 202, other than definitions of a first pitch orientation and a second pitch orientation as described below. Accordingly, a detailed explanation thereabout is omitted.

As shown in FIG. 7, each of the contacts 200 of the present embodiment has a fixed portion 210, a regulated portion 220, a held portion 280, an extending portion 290, a contact portion 292 and a coupling portion 230.

As shown in FIG. 6, the fixed portion 210 of the present embodiment is fixed to the circuit board 800 by soldering or the like when the floating connector 100 is mounted on the circuit board 800. The fixed portion 210 extends downward from the regulated portion 220 and is bent to extend outward in the horizontal direction. The fixed portion 210 defines an outer end of the contact 200 in the horizontal direction. The fixed portion 210 is positioned outward beyond the movable housing 300 in the horizontal direction. The fixed portion 210 is positioned outward beyond the surrounding portion 302 in the horizontal direction.

As shown in FIG. 6, the regulated portion 220 of the present embodiment extends upward in the up-down direction from the fixed portion 210. The regulated portion 220 is positioned outward beyond the movable housing 300 in the horizontal direction. The regulated portion 220 is positioned outward beyond the surrounding portion 302 in the horizontal direction. As shown in FIG. 7, the regulated portion 220 has a plurality of protrusions 222 each protruding outward in the pitch direction.

Referring to FIG. 6, a movement of the regulated portion 220 in the pitch direction perpendicular to the up-down direction is regulated by the regulating portion 420. More specifically, the regulated portion 220 is held by the regulating portion 420. The regulated portion 220 is press-fit into the regulating portion 420. The protrusion 222 of the regulated portion 220 bites into the inner wall of the ditch of the regulating portion 420. More specifically, the protrusion 222, which is positioned at a side of the regulated portion 220 in a first pitch orientation, bites into the inner wall which is positioned at a side of the ditch of the regulating portion 420 in the first pitch orientation. Similarly, the protrusion 222, which is positioned at a side of the regulated portion 220 in a second pitch orientation, bites into the inner wall which is positioned at a side of the ditch of the regulating portion 420 in the second pitch orientation. In the present embodiment, the first pitch orientation is a positive Y-direction while the second pitch orientation is a negative Y-direction. Regarding the contact 200 of the contact row 204 as shown in FIG. 6, it is assumed that the first pitch orientation is the negative Y-direction while the second pitch orientation is the positive Y-direction.

As shown in FIG. 6, the held portion 280 of the present embodiment extends upward in the up-down direction. The held portion 280 is positioned below the accommodating portion 304 in the up-down direction. The held portion 280 is held by the holding portion 320. More specifically, the held portion 280 is press-fit into the holding portion 320. In other words, the contacts 200 are held by the movable housing 300. As shown in FIG. 7, the held portion 280 has a plurality of protrusions 282 and a connecting portion 283.

Referring to FIGS. 6 and 7, each of the protrusions 282 protrudes outward in the pitch direction. The protrusion 282 bites into the inner wall of the ditch of the holding portion 320. More specifically, the protrusion 282, which is positioned at a side of the held portion 280 in the first pitch orientation, bites into the inner wall which is positioned at a side of the ditch of the holding portion 320 in the first pitch orientation. Similarly, the protrusion 282, which is positioned at a side of the held portion 280 in the second pitch orientation, bites into the inner wall which is positioned at a side of the ditch of the holding portion 320 in the second pitch orientation.

Figure 9:
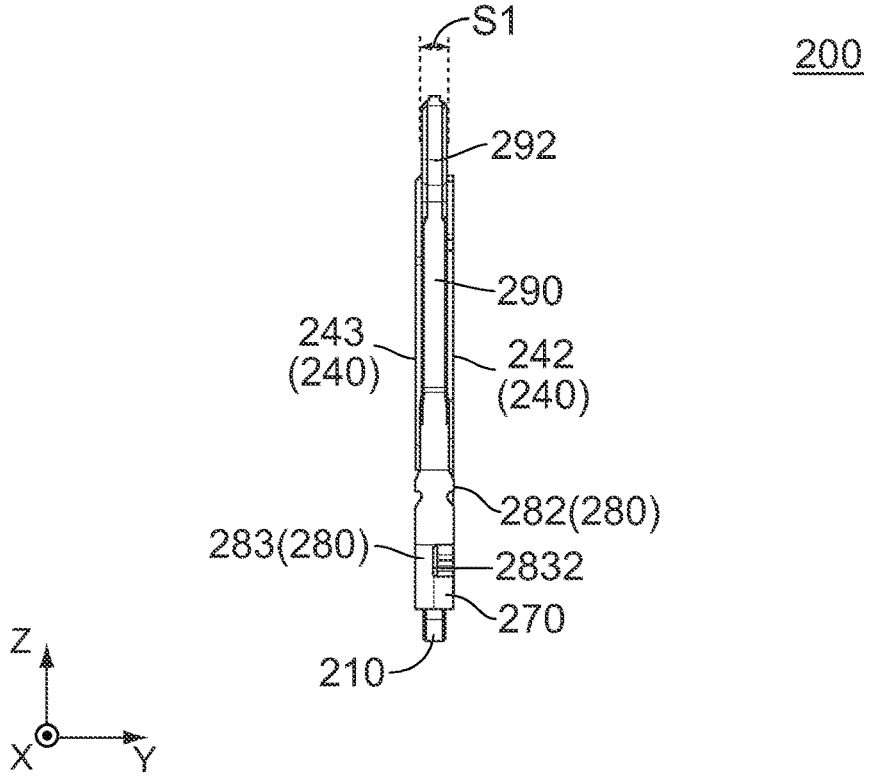
FIG. 9 is a front view showing the contact of FIG. 7.

As shown in FIG. 9, the connecting portion 283 of the present embodiment defines a lower end of the held portion 280 in the up-down direction. The connecting portion 283 has an end portion 2832 which faces in the first pitch orientation of the pitch direction. The end portion 2832 is positioned in the second pitch orientation beyond the protrusion 282 which is positioned at the side of the held portion 280 in the first pitch orientation Referring to FIG. 13, the extending portion 290 of the present embodiment extends upward in the up-down direction from held portion 280. The extending portion 290 supports the contact portion 292 so that the contact portion 292 is movable. The extending portion 290 is resiliently deformable in the horizontal direction. However, the present invention is not limited thereto. The extending portion 290 may be configured to support the contact portion 292 so that the contact portion 292 is immovable, provided that the mating contact portion 610 is configured to be resiliently movable.

Figure 13:
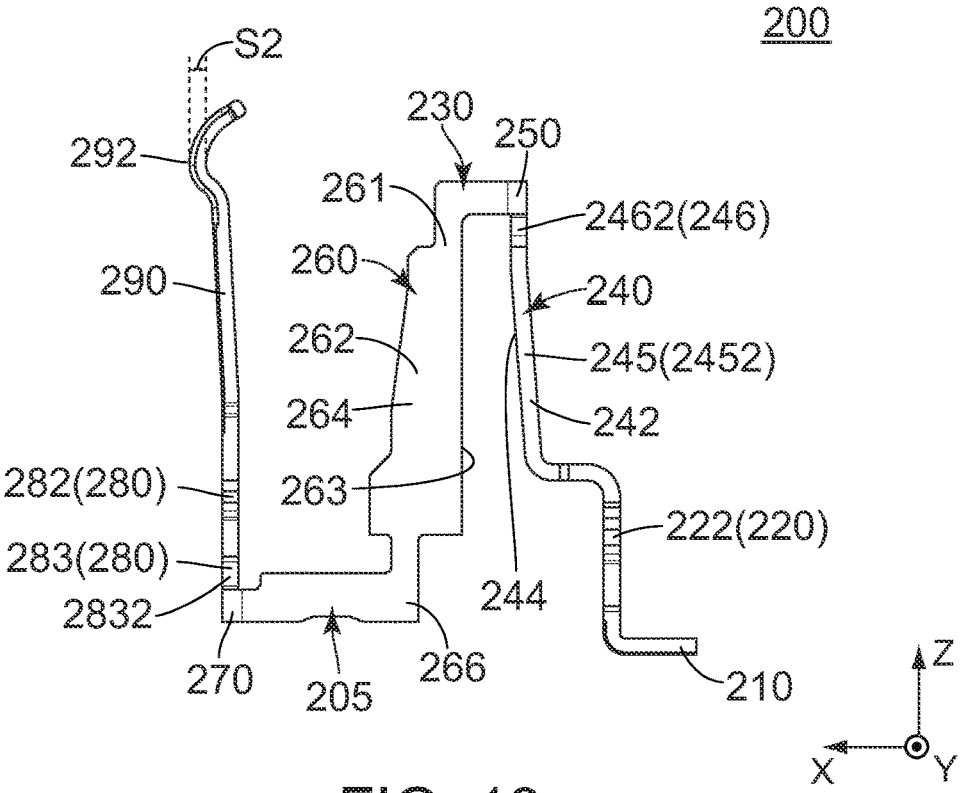
FIG. 13 is a side view showing the contact of FIG. 7.

Referring to FIG. 13, the contact portion 292 of the present embodiment is supported by the extending portion 290. More specifically, the contact portion 292 is resiliently supported by the extending portion 290 so as to be movable in the horizontal direction. As shown in FIG. 6, the contact portion 292 is positioned in the accommodating portion 304. As shown in FIG. 3, the contact portion 292 is brought into contact with the mating contact portion 610 when the floating connector 100 is mated with the mating connector 600. The contact portion 292 is formed by bending a blank. Referring to FIGS. 9 and 13, the contact portion 292 has a first size S1 in the pitch direction and has a second size S2 in the horizontal direction perpendicular to both the pitch direction and the up-down direction. Specifically, the first size S1 is greater than the second size S2. A surface of the contact portion 292, which is configured to be brought into contact with the mating contact portion 610, is a roll surface of a base metal plate. In other words, the surface of the contact portion 292, which is configured to be brought into contact with the mating contact portion 610, is not a rough, broken face of a base metal plate. If the surface of the contact portion 292, which is configured to be brought into contact with the mating contact portion 610, is the rough, broken face, this causes problems as follows: a contact area is reduced between the contact portion 292 and the mating contact portion 610 by the rough, broken face of the contact portion 292 being brought into contact with the mating contact portion 610 upon mating of a floating connector 100 with the mating connector 600; and the contact portion 292 and the mating contact portion 610 are abraded by the rough, broken face of the contact portion 292 being brought into contact with the mating contact portion 610 upon mating of the floating connector 100 with the mating connector 600. In contrast, the contact portion 292 of the present embodiment does not cause such a problem.

Referring to FIG. 7, the coupling portion 230 of the present embodiment couples the regulated portion 220 and the held portion 280 with each other. Referring to FIGS. 4 and 6, the coupling portion 230 is resiliently deformable, and the movable housing 300 is movable within a predetermined range PA in the plane perpendicular to the up-down direction by the resilient deformation of the coupling portion 230. In other words, the resilient reformation of the coupling portion 230 enables the movable housing 300 not only to be movable in the horizontal direction to some extent but also to be movable in the pitch direction to some extent.

As described above, the regulated portion 220 is held by the regulating portion 420. As compared with a floating connector in which a movement of the regulated portion 220 is simply regulated by the regulating portion 420, this holding can suppress transmission of stress occurred by the resilient deformation of the contact 200, which is caused by the movement of the movable housing 300, to the fixed portion 210 fixed to the circuit board 800. Thus, the floating connector 100 of the present embodiment is configured so that the movement of the movable housing 300 hardly weakens the fixing of the fixed portion 210 to the circuit board 800 by soldering or the like.

As shown in FIG. 7, the coupling portion 230 of the present embodiment has a first portion 260, a second portion 240 and a bent portion 250. Specifically, the bent portion 250 connects the first portion 260 and the second portion 240 with each other.

As shown in FIG. 13, the first portion 260 of the present embodiment is positioned between the held portion 280 and the bent portion 250. The first portion 260 has an upper end 261, a principal surface 262 and an end surface 263.

As shown in FIG. 13, the upper end 261 of the present embodiment is the uppermost end of the first portion 260 in the up-down direction.

As shown in FIG. 13, the principal surface 262 of the present embodiment faces in the pitch direction. In other words, a thickness direction of the principal surface 262 is the pitch direction. The principal surface 262 intersects with the pitch direction. More specifically, the principal surface 262 is perpendicular to the pitch direction. The principal surface 262 is a roll surface of a base metal plate. In other words, the principal surface 262 is not a rough, broken face of a base metal plate.

As shown in FIG. 7, the end surface 263 of the present embodiment faces in the horizontal direction. The end surface 263 intersects with the horizontal direction. The end surface 263 is a rough, broken face of a base metal plate. In other words, the end surface 263 is not a roll surface of a base metal plate.

As shown in FIG. 13, the first portion 260 has a wide portion 264 and a narrow portion 266. Specifically, the wide portion 264 has a size greater than an average size of the first portion 260, and the narrow portion 266 has a size smaller than the average size of the first portion 260.

As shown in FIG. 13, the wide portion 264 of the present embodiment is positioned below the bent portion 250 in the up-down direction. The wide portion 264 extends downward from a lower end of the bent portion 250. In a plane parallel to the principal surface 262, the wide portion 264 has the size greater than the average size of the first portion 260. The wide portion 264 extends in a plane which is defined by the up-down direction and the horizontal direction. As shown in FIG. 6, the wide portion 264 is positioned outward beyond the movable housing 300 in the horizontal direction. The wide portion 264 is positioned outward beyond the surrounding portion 302 in the horizontal direction.

As shown in FIG. 13, the narrow portion 266 of the present embodiment is positioned below the wide portion 264 in the up-down direction. The narrow portion 266 extends downward from a lower end of the wide portion 264. In the plane parallel to the principal surface 262, the narrow portion 266 has the size smaller than the average size of the first portion 260. Specifically, in the plane parallel to the principal surface 262, the wide portion 264 is wider than the narrow portion 266. Accordingly, the wide portion 264 has a reduced impedance in the first portion 260. This enables impedance of the first portion 260 to be adjusted at the wide portion 264. As shown in FIG. 6, the narrow portion 266 is positioned below the movable housing 300 in the up-down direction.

Figure 8:
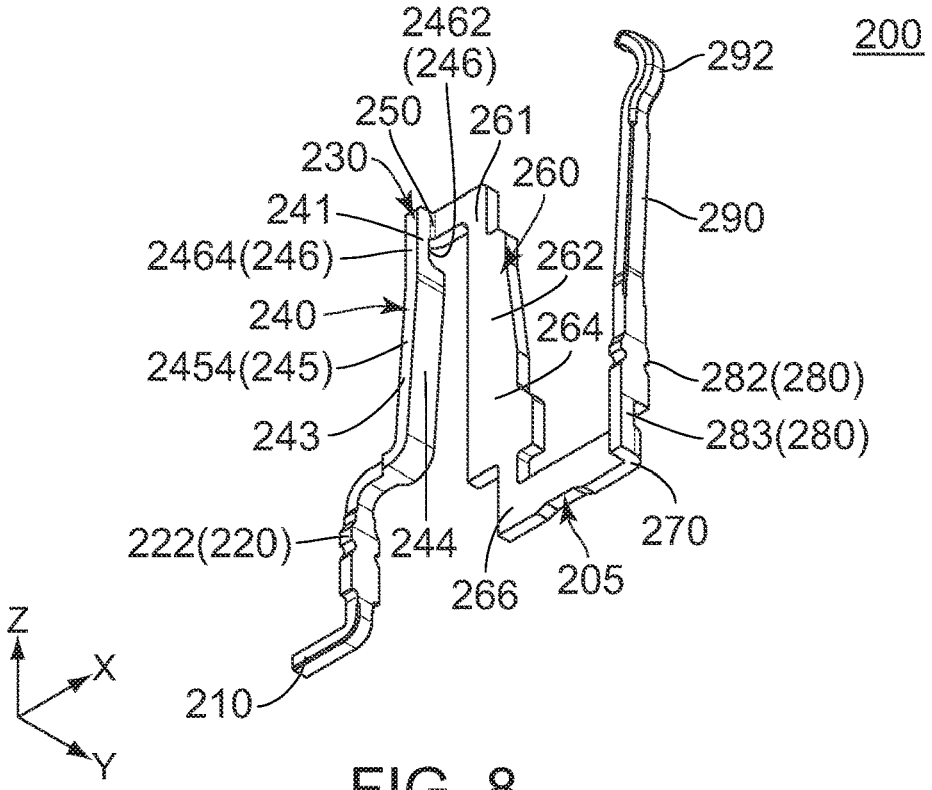
FIG. 8 is a lower, perspective view showing the contact of FIG. 7.

As shown in FIG. 8, the second portion 240 of the present embodiment is positioned between the regulated portion 220 and the bent portion 250. The second portion 240 couples the regulated portion 220 and the bent portion 250 with each other. As shown in FIG. 6, the second portion 240 is positioned outward beyond the movable housing 300 in the horizontal direction. The second portion 240 is positioned outward beyond the surrounding portion 302 in the horizontal direction. As shown in FIG. 8 again, the second portion 240 has an upper end 241, end surfaces 242, 243 and a principal surface 244.

As shown in FIG. 8, the upper end 241 of the present embodiment is the uppermost end of the second portion 240 in the up-down direction.

Figure 10:
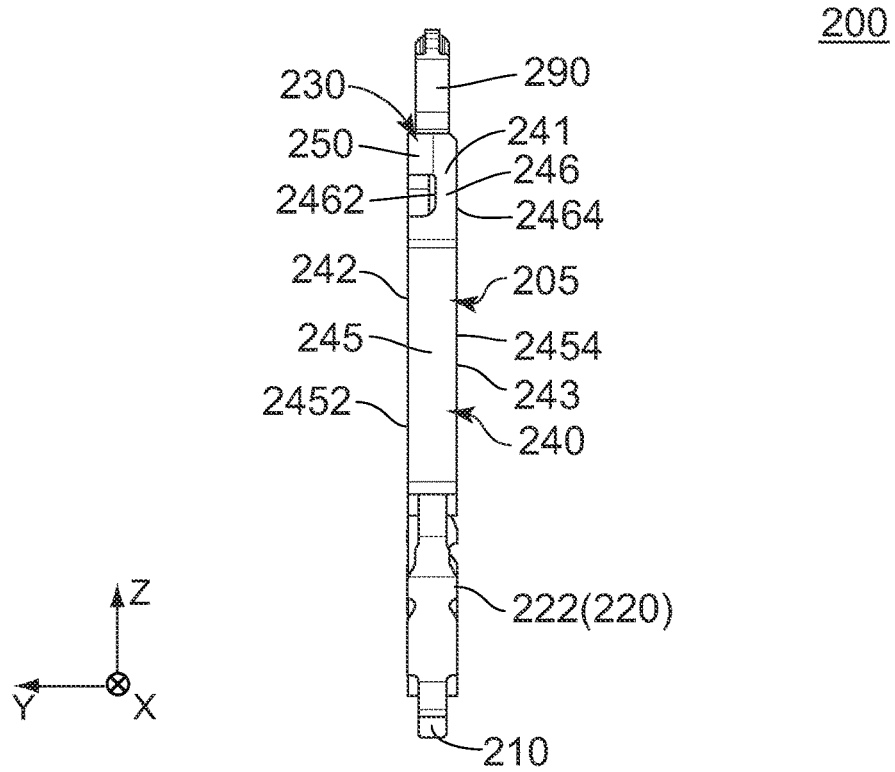
FIG. 10 is a rear view showing the contact of FIG. 7.

As shown in FIG. 10, the end surfaces 242, 243 of the present embodiment define opposite outward ends, respectively, of the second portion 240 in the pitch direction. Each of the end surfaces 242, 243 intersects with the pitch direction. The end surfaces 242 faces in the first pitch orientation of the pitch direction. The end surface 243 faces in the second pitch orientation of the pitch direction. The end surface 242 is positioned in the first pitch orientation beyond the end surface 243. Each of the end surfaces 242, 243 is a rough, broken face of a base metal plate. In other words, each of the end surfaces 242, 243 is not a roll surface of a base metal plate.

As shown in FIG. 7, the principal surface 244 of the present embodiment faces in the horizontal direction. In other words, a thickness direction of the principal surface 244 is the horizontal direction. The principal surface 244 intersects with the horizontal direction. More specifically, the principal surface 244 is perpendicular to the horizontal direction. The principal surface 244 is a roll surface of a base metal plate. In other words, the principal surface 244 is not a rough, broken face of a base metal plate.

Referring to FIG. 7, the principal surface 262 of the first portion 260 faces in a first direction. The principal surface 244 of the second portion 240 faces in a second direction. Specifically, the first direction is different from the second direction. In other words, the thickness direction of the first portion 260 is different from the thickness direction of the second portion 240. More specifically, the direction in which the principal surface 262 of the first portion 260 faces is perpendicular to the direction in which the principal surface 244 of the second portion 240 faces. In other words, the thickness direction of the first portion 260 is perpendicular to the thickness direction of the second portion 240. Thus, the floating connector 100 of the present embodiment is configured so that, upon the movement of the movable housing 300, the second portion 240 is resiliently deformed in response to a horizontal directional component of the movement of the movable housing 300 while the first portion 260 is resiliently deformed in response to a pitch directional component of the movement of the movable housing 300. By this configuration, the floating connector 100 of the present embodiment can suppress occurrence of torsional stress in the held portion 280 of the contact 200 even when the movable housing 300 is moved in the pitch direction.

As shown in FIG. 10, the second portion 240 has a lower portion 245 and an upper portion 246. Specifically, the lower portion 245 has a size greater than an average size of the second portion 240, and the upper portion 246 has a size smaller than the average size of the second portion 240.

As shown in FIG. 13 the lower portion 245 of the present embodiment extends upward in the up-down direction from the regulated portion 220. The lower portion 245 extends inward in the horizontal direction from the regulated portion 220. More specifically, the lower portion 245 is bent to extend inward in the horizontal direction from the regulated portion 220, and is bent to extend upward in the up-down direction and inward in the horizontal direction. As shown in FIG. 10, the lower portion 245 has two end portions 2452, 2454 which are positioned at its opposite ends, respectively, in the pitch direction. The end portion 2452 is positioned in the first pitch orientation beyond the end portion 2454. The end portion 2452 of the lower portion 245 is the end surface 242 of the second portion 240.

As shown in FIG. 13, the upper portion 246 of the present embodiment extends upward in the up-down direction from the lower portion 245. The upper end 241 is also the uppermost end of the upper portion 246 in the up-down direction. As shown in FIG. 10, the upper portion 246 has two end portions 2462, 2464 which are positioned its opposite ends, respectively, in the pitch direction. The end portion 2462 is positioned in the first pitch orientation beyond the end portion 2464.

As shown in FIG. 10, the end portion 2462 of the upper portion 246 is positioned in the second pitch orientation beyond the end portion 2452 of the lower portion 245. Referring to FIG. 8, the end portion 2462 of the upper portion 246 is positioned in the second pitch orientation beyond the first portion 260. The end portion 2462 of the upper portion 246 is positioned in the second pitch orientation beyond the wide portion 264. The end portion 2462 of the upper portion 246 is positioned in the second pitch orientation beyond the narrow portion 266.

As shown in FIG. 10, the end portion 2464 of the upper portion 246 is positioned at a position same as a position of the end portion 2454 of the lower portion 245 in the pitch direction. Referring to FIG. 8, the end portion 2464 of the upper portion 246 is positioned in the second pitch orientation beyond the first portion 260. The end surface 243 of the second portion 240 consists of the end portion 2454 and the end portion 2464.

Figure 11:
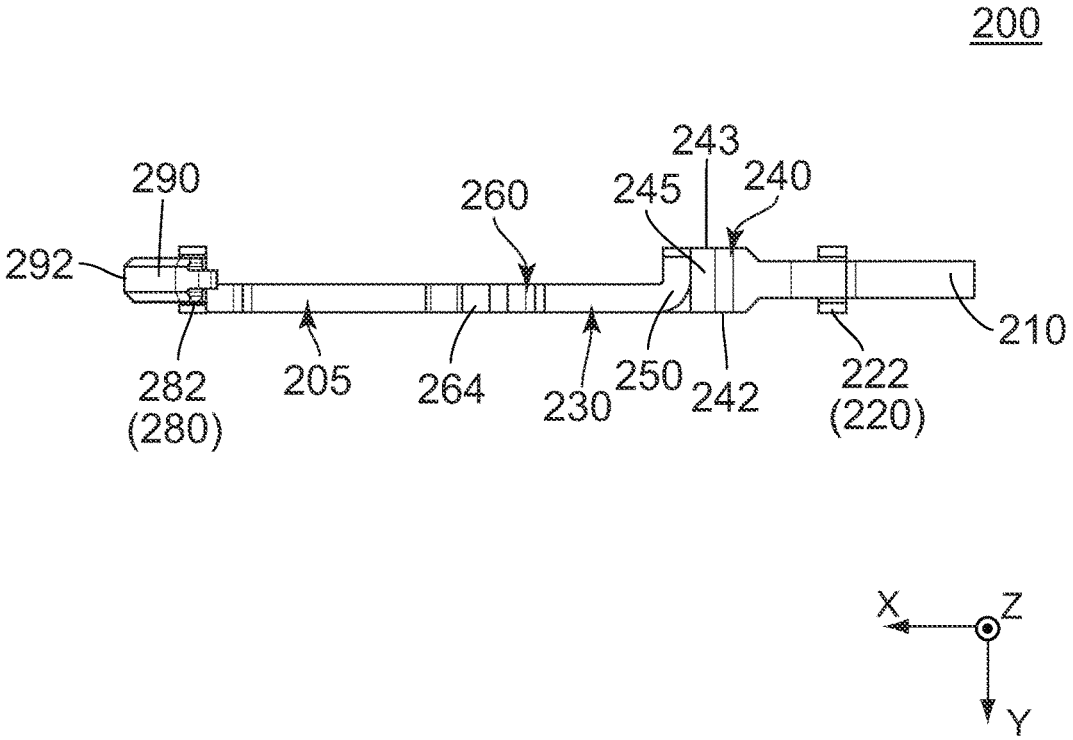
FIG. 11 is a top view showing the contact of FIG. 7.
Figure 12:
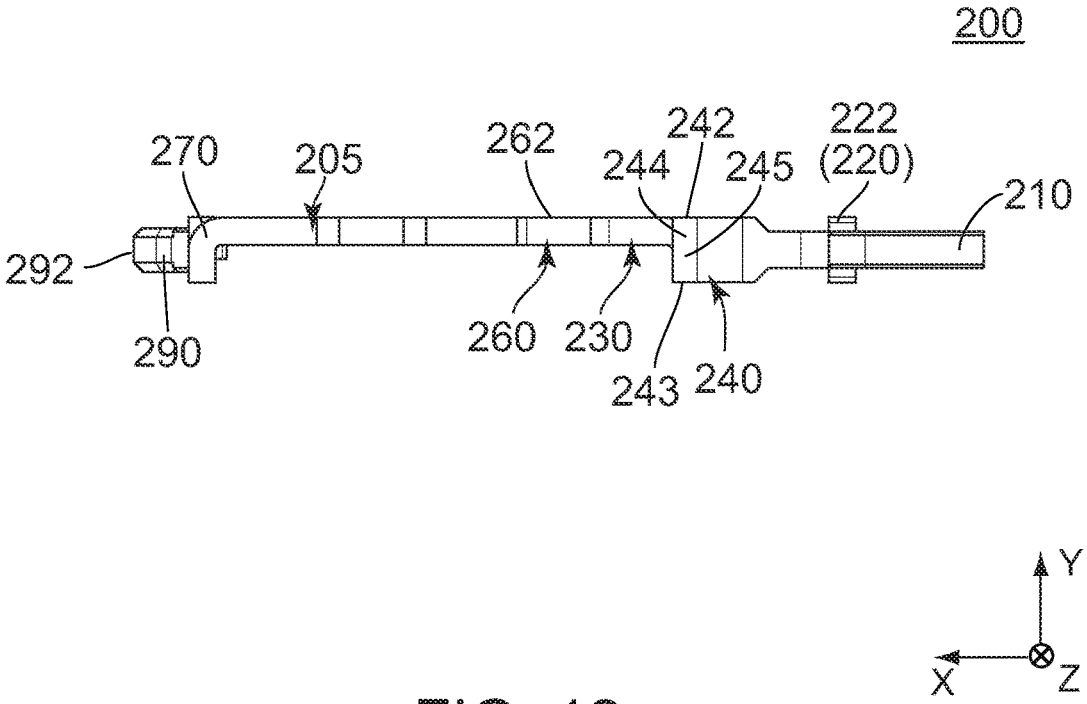
FIG. 12 is a bottom view showing contact of FIG. 7.

As shown in FIG. 8, the bent portion 250 of the present embodiment connects the upper end 261 of the first portion 260 and the upper end 241 of the second portion 240 with each other. The bent portion 250 extends from the upper portion 246. In detail, the bent portion 250 extends in the first pitch orientation from the end portion 2462 of the upper portion 246 and is bent to extend inward in the horizontal direction. As shown in FIG. 13, the bent portion 250 is positioned above the first portion 260 in the up-down direction. The bent portion 250 is positioned above the second portion 240 in the up-down direction. As shown in FIG. 11, the bent portion 250 overlaps with the lower portion 245 when the contact 200 is viewed along the up-down direction. The bent portion 250 is positioned between the end surfaces 242 and 243 of the second portion 240 in the pitch direction. This enables the bent portion 250 to be easily formed by bending the blank. Additionally, this enables the contact row 202, 204 (see FIG. 6) to have a reduced size in the pitch direction to some extent. As shown in FIG. 6, the bent portion 250 is positioned outward beyond the movable housing 300 in the horizontal direction. The bent portion 250 is positioned outward beyond the surrounding portion 302 in the horizontal direction.

As shown in FIG. 7, each of the fixed portion 210, the regulated portion 220 and the principal surface 244 of the second portion 240 intersects with the horizontal direction. Specifically, a part of the fixed portion 210, which extends upward, intersects with the horizontal direction. Additionally, the regulated portion 220 extends in a direction intersecting with the horizontal direction. Furthermore, the principal surface 244 of the second portion 240 faces in a direction intersecting with the horizontal direction. More specifically, the part of the fixed portion 210, which extends upward, is perpendicular to the horizontal direction, the regulated portion 220 extends in the direction perpendicular to the horizontal direction, and the principal surface 244 of the second portion 240 faces in the direction perpendicular to the pitch direction. This can prevent significant variation of impedance at a connecting part of the circuit board 800 (see FIG. 6) and the contact 200 while the contact 200 is provided with no other bent portion.

As shown in FIG. 7, the coupling portion 230 of the present embodiment further has an additional bent portion 270 which couples the held portion 280 and the first portion 260 with each other.

As shown in FIG. 7, the additional bent portion 270 of the present embodiment is positioned between the held portion 280 and the first portion 260. The held portion 280 is positioned between the additional bent portion 270 and the extending portion 290. The additional bent portion 270 couples the held portion 280 and the first portion 260 with each other. The additional bent portion 270 couples the connecting portion 283 and the first portion 260 with each other. The additional bent portion 270 extends in the horizontal direction from the first portion 260 and is bent to extend in the second pitch orientation. As shown in FIG. 13, the additional bent portion 270 is positioned below the held portion 280 in the up-down direction. The additional bent portion 270 is positioned below the wide portion 264 in the up-down direction. The additional bent portion 270 is positioned below the bent portion 250 in the up-down direction. The additional bent portion 270 is positioned below the second portion 240 in the up-down direction. The additional bent portion 270 is positioned below the regulated portion 220 in the up-down direction. As shown in FIG. 6, the additional bent portion 270 is positioned below the movable housing 300 in the up-down direction.

As described above, the contact 200 of the present embodiment has the additional bent portion 270. This enables the contact 200 to be configured so that, without modifying a shape of the second portion 240, the contact portion 292 is formed of a roll surface of a base metal plate while the wide portion 264 used for impedance adjustment extends in a plane defined by the up-down direction and the horizontal direction. More specifically, if the contact 200 has no additional bent portion 270 but has the contact portion 292 of a roll surface of a base metal plate, the first portion 260 of the thus-configured contact 200 necessarily extends in a plane defined by the up-down direction and the pitch direction. It is of disadvantage that the thus-configured contacts 200 are arranged at increased intervals because the wide portion 264 of the first portion 260 is wide. If the thus-configured contact 200, which has no additional bent portion 270 but has the contact portion 292 of is the roll surface, is modified so that a portion equivalent to the wide portion 264 is provided at the second portion 240 while the first portion 260 has no wide portion 264, the modified contact 200 has disadvantage as follows: a part of the modified contact 200 around the fixed portion 210 has an increased size and thereby impedances of a pad (not shown) of the circuit board 800 and the fixed portion 210 might be mismatched with each other. In contrast, the contact 200 of the present embodiment does not have the aforementioned disadvantages because the contact 200 has the additional bent portion 270.

Where the first embodiment of the present invention is described above, the contact 200 of the present embodiment may be modified as follows.

(First Modification)

Figure 14:
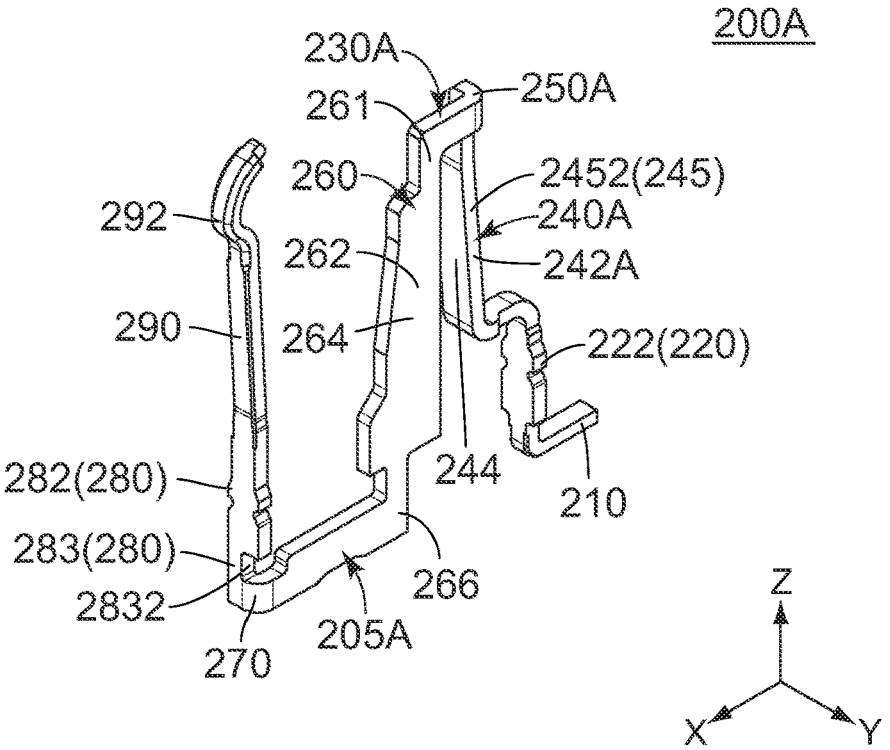
FIG. 14 is an upper, perspective view showing a first modification of the contact of FIG. 7.

Referring to FIG. 14, a contact 200A according to a first modification is made of a single metal plate 205A. The contact 200A is a so-called bent contact. The contact 200A has a fixed portion 210, a regulated portion 220, a held portion 280, an extending portion 290, a contact portion 292 and a coupling portion 230A. Components of the contact 200A other than the coupling portion 230A have structures same as those of the first embodiment. Accordingly, a detailed explanation thereabout is omitted.

As shown in FIG. 14, the coupling portion 230A of the present modification couples the regulated portion 220 and the held portion 280 with each other. The coupling portion 230A is resiliently deformable. The coupling portion 230A has a first portion 260, a second portion 240A and a bent portion 250A which connects the first portion 260 and the second portion 240A with each other. The first portion 260 of the present modification has a structure same as that of the first portion 260 of the aforementioned first embodiment. Accordingly, a detailed explanation thereabout is omitted.

Figure 15:
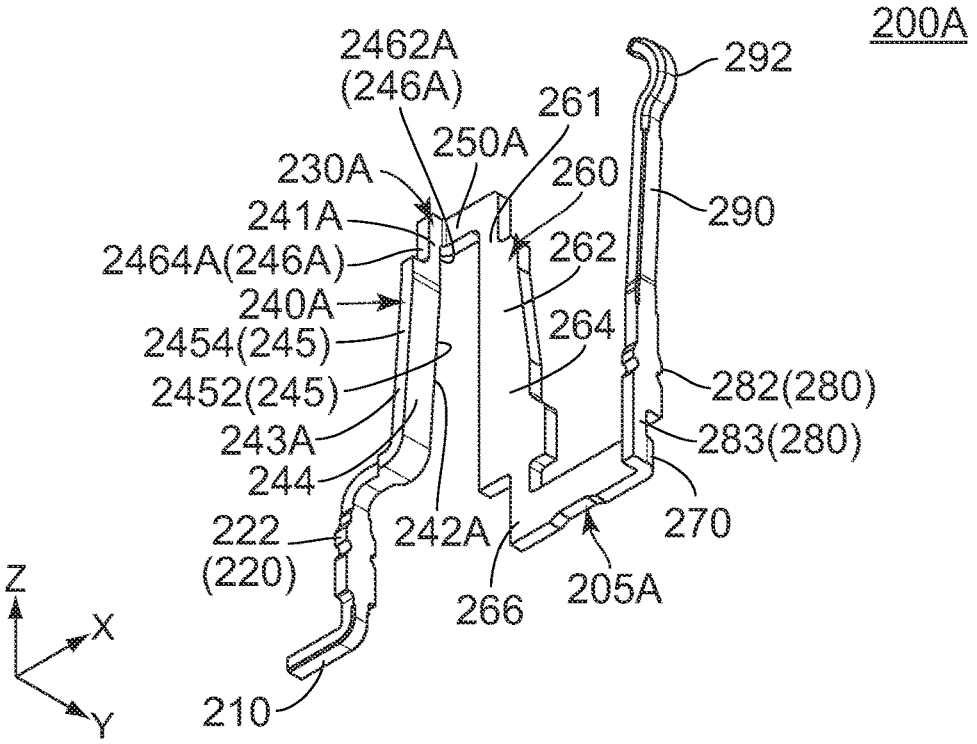
FIG. 15 is a lower, perspective view showing the contact of FIG. 14.
Figure 16:
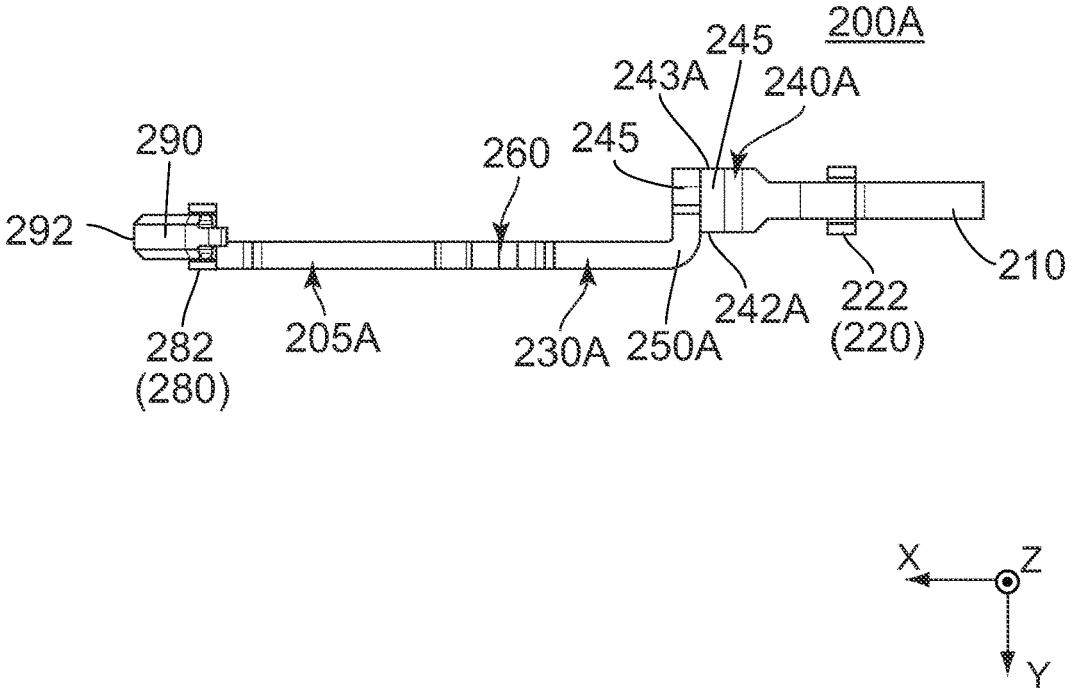
FIG. 16 is a top view showing the contact of FIG. 14.
Figure 17:
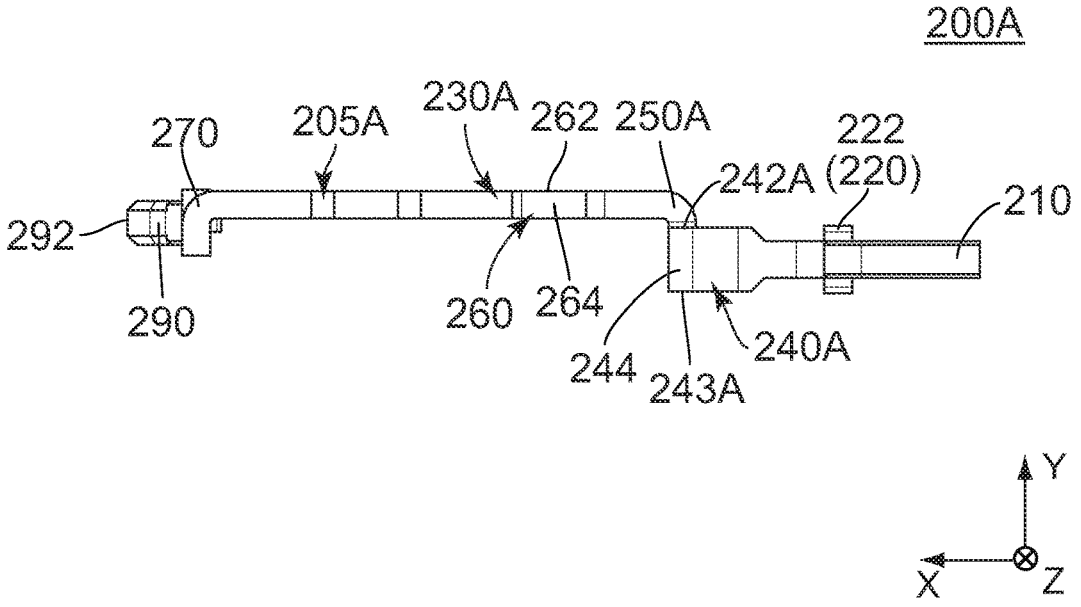
FIG. 17 is a bottom view showing the contact of FIG. 14.
Figure 18:
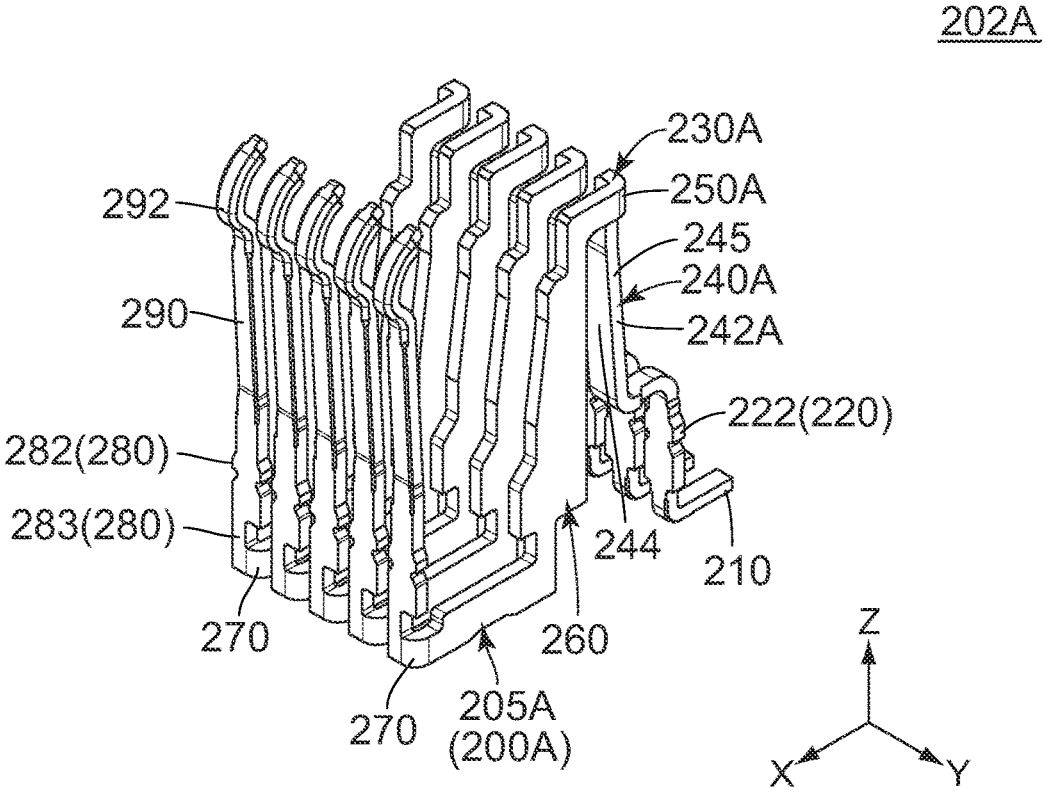
FIG. 18 is an upper, perspective view showing a contact row formed by several of the contacts of FIG. 14.

As shown in FIG. 15, the second portion 240A of the present modification has an upper end 241A, end surfaces 242A, 243A, a principal surface 244, a lower portion 245 and an upper portion 246A. Specifically, the lower portion 245 has a size greater than an average size of the second portion 240A, and the upper portion 246A has a size smaller than the average size of the second portion 240A. The principal surface 244 and the lower portion 245 of the present modification have structures same as those of the principal surface 244 and the lower portion 245 of the aforementioned first embodiment. Accordingly, a detailed explanation thereabout is omitted.

As shown in FIG. 15, the upper end 241A of the present modification is the uppermost end of the second portion 240A in the up-down direction.

As shown in FIG. 15, the end surfaces 242A, 243A of the present modification define opposite outward ends, respectively, of the second portion 240A in the pitch direction. Each of the end surfaces 242A, 243A intersects with the pitch direction. The end surface 242A faces in the first pitch orientation of the pitch direction. The end surface 243A faces in the second pitch orientation of the pitch direction. The end surface 242A is positioned in the first pitch orientation beyond the end surface 243A. Each of the end surfaces 242A, 243A is a rough, broken face of a base metal plate. In other words, each of the end surfaces 242A, 243A is not a roll surface of a base metal plate.

As shown in FIG. 15, the upper portion 246A of the present modification extends upward in the up-down direction from the lower portion 245. The upper end 241A is the uppermost end of the upper portion 246A in the up-down direction. The upper portion 246A has two end portions 2462A, 2464A which are positioned at its opposite ends, respectively, in the pitch direction. The end portion 2462A is positioned in the first pitch orientation beyond the end portion 2464A.

Figure 19:
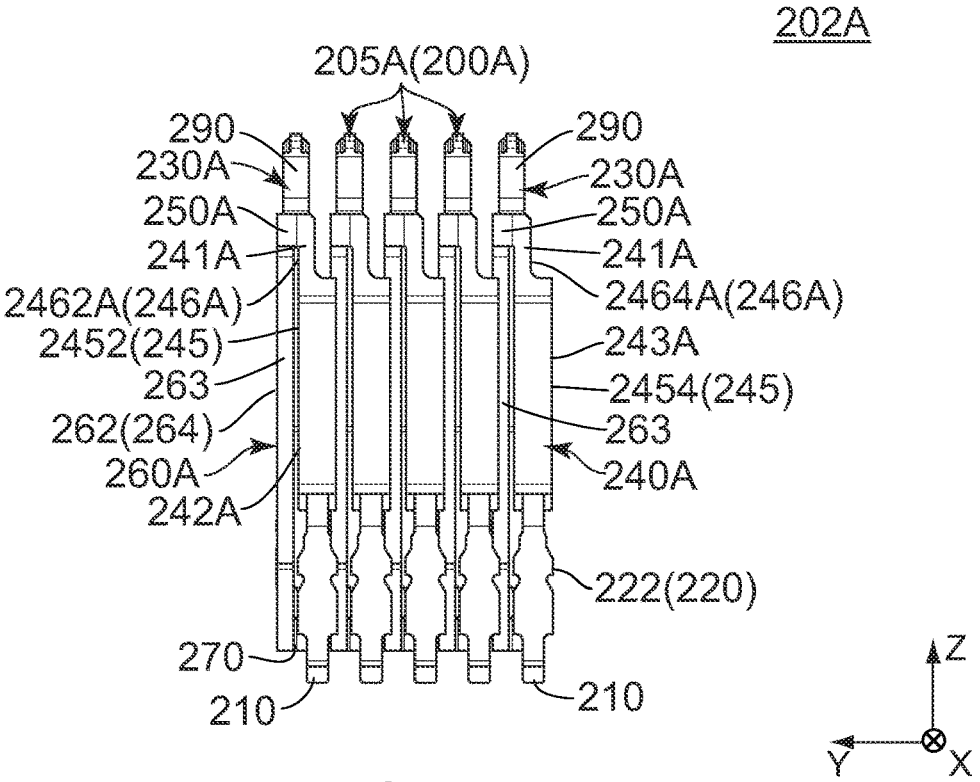
FIG. 19 is a rear view showing the contact row of FIG. 18.

As shown in FIG. 19, the end portion 2462A of the upper portion 246A is positioned at a position same as a position of the end portion 2452 of the lower portion 245 in the pitch direction. The end surface 242A of the second portion 240A consists of the end portion 2452 and the end portion 2462A.

As shown in FIG. 19, the end portion 2464A of the upper portion 246A is positioned in the first pitch orientation beyond the end portion 2454 of the lower portion 245. As shown in FIG. 15, the end portion 2464A of the upper portion 246A is positioned in the second pitch orientation beyond the first portion 260. The end portion 2464A of the upper portion 246A is positioned in the second pitch orientation beyond a wide portion 264. The end portion 2464A of the upper portion 246A is positioned in the second pitch orientation beyond a narrow portion 266.

As shown in FIG. 15, the bent portion 250A of the present modification connects an upper end 261 of the first portion 260 and the upper end 241A of the second portion 240A with each other. The bent portion 250A extends from the upper portion 246A. More specifically, the bent portion 250A extends in the first pitch orientation from the end portion 2462A of the upper portion 246A and is bent to extend inward in the horizontal direction. As shown in FIG. 14, the bent portion 250A is positioned above the first portion 260 in the up-down direction. The bent portion 250A is positioned above the second portion 240A in the up-down direction. As shown in FIG. 19, the bent portion 250A is positioned outward beyond the end surface 242A which is positioned at a side of the second portion 240A in the pitch direction. In other words, the bent portion 250A is positioned outward in the pitch direction beyond the end surface 242A of the second portion 240A. More specifically, the bent portion 250A is positioned outward beyond the end portion 2452 which is positioned at a side of the lower portion 245 in the first pitch orientation. In other words, the bent portion 250A is positioned outward in the first pitch orientation beyond the end portion 2452 of the lower portion 245.

Figure 20:
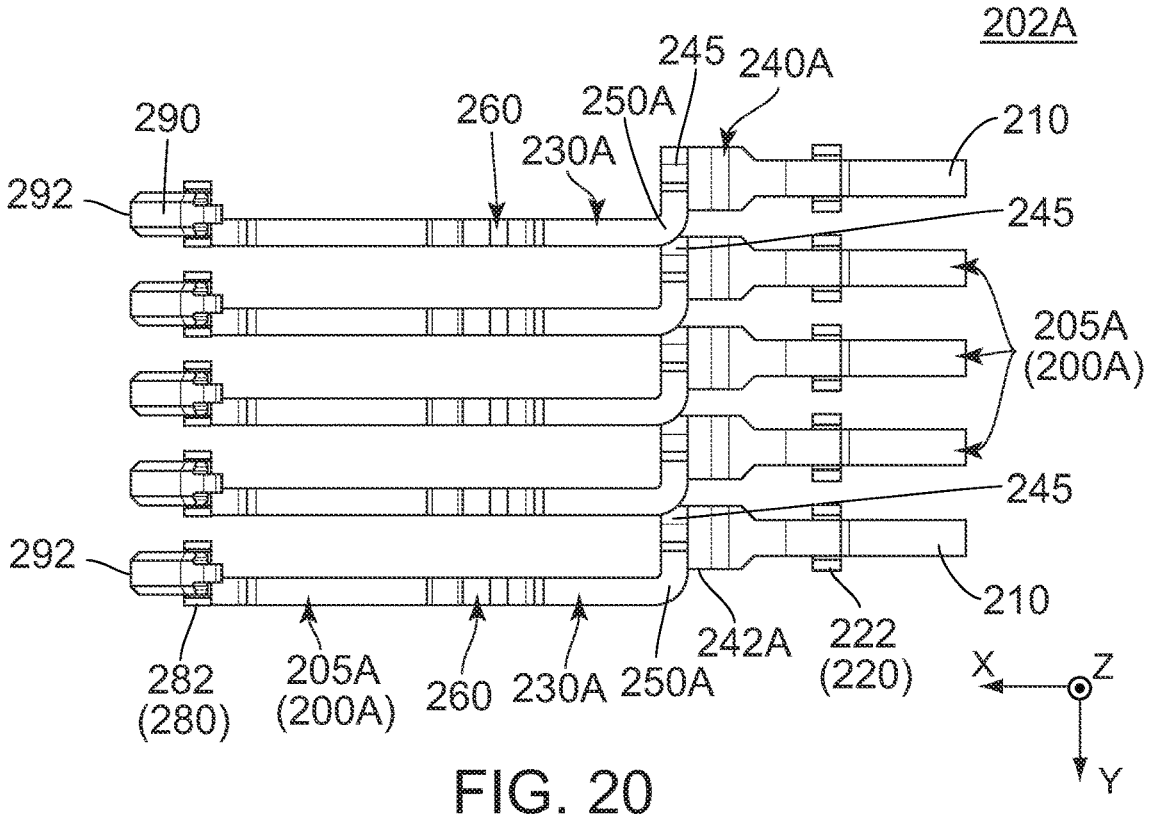
FIG. 20 is a top view showing the contact row of FIG. 18.

As shown in FIG. 20, the bent portion 250A of one of two of the contacts 200A, which are adjacent to each other, overlaps with the second portion 240A of a remaining one of the two contacts 200A when the contact row 202A is viewed along the up-down direction. Specifically, the bent portion 250A of one of two of the contacts 200A, which are adjacent to each other, overlaps with the lower portion 245 of a remaining one of the two contacts 200A when the contact row 202A is viewed along the up-down direction. More specifically, when the contact row 202A is viewed along the up-down direction, the bent portion 250A of one of neighboring two of the contacts 200A that is positioned in the second pitch orientation beyond a remaining one of the neighboring two contacts 200A overlaps with the lower portion 245 of the remaining one thereof which is positioned in the first pitch orientation beyond the one thereof.

As understood from FIGS. 14 and 20, the aforementioned configuration of the bent portion 250A enables an end surface 263 of the first portion 260 and the principal surface 244 of the second portion 240A to be positioned away from each other in the contact 200A itself. Thus, the contact 200A can have improved high frequency characteristics.

(Second Modification)

Figure 22:
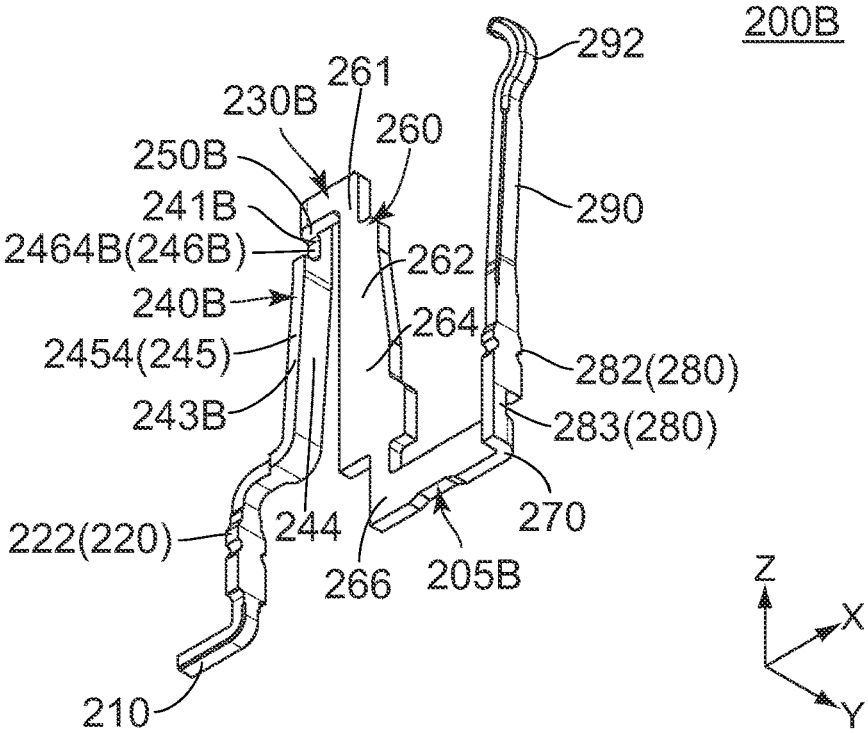
FIG. 22 is a lower, perspective view showing the contact of FIG. 21.

Referring to FIG. 22, a contact 200B according to a second modification is made of a single metal plate 205B. The contact 200B is a so-called bent contact. The contact 200B has a fixed portion 210, a regulated portion 220, a held portion 280, an extending portion 290, a contact portion 292 and a coupling portion 230B. Components of the contact 200B other than the coupling portion 230B have structures same as those of the first embodiment. Accordingly, a detailed explanation thereabout is omitted.

As shown in FIG. 22, the coupling portion 230B of the present modification couples the regulated portion 220 and the held portion 280 with each other. The coupling portion 230B is resiliently deformable. The coupling portion 230B has a first portion 260, a second portion 240B and a bent portion 250B which connects the first portion 260 and the second portion 240B with each other. The first portion 260 of the present modification has a structure same as that of the first portion 260 of the aforementioned first embodiment. Accordingly, a detailed explanation thereabout is omitted.

As shown in FIG. 22, the second portion 240B of the present modification has an upper end 241B, end surfaces 242B, 243B, a principal surface 244, a lower portion 245 and an upper portion 246B. Specifically, the lower portion 245 has a size greater than an average size of the second portion 240B, and the upper portion 246B has a size smaller than the average size of the second portion 240B. The principal surface 244 and the lower portion 245 of the present modification have structures same as those of the principal surface 244 and the lower portion 245 of the aforementioned first embodiment. Accordingly, a detailed explanation thereabout is omitted.

Figure 21:
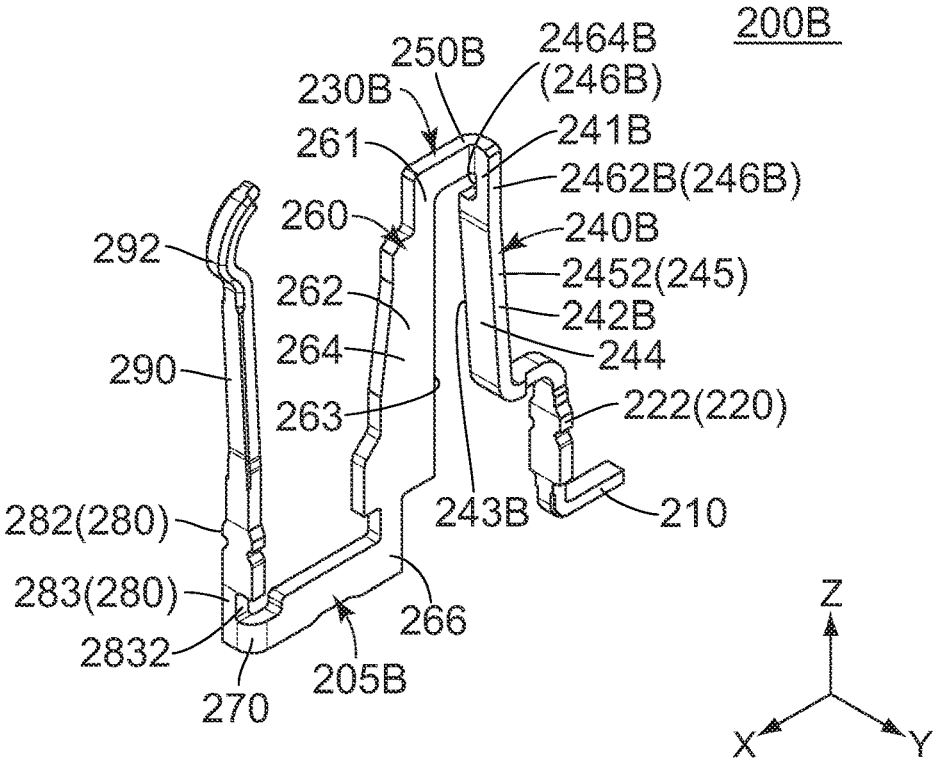
FIG. 21 is an upper, perspective view showing a second modification of the contact of FIG. 7.

As shown in FIG. 21, the upper end 241B of the present modification is the uppermost end of the second portion 240B in the up-down direction.

As shown in FIG. 21, the end surfaces 242B, 243B of the present modification define opposite outward ends, respectively, of the second portion 240B in the pitch direction. Each of the end surfaces 242B, 243B intersects with the pitch direction. The end surface 242B faces in the first pitch orientation of the pitch direction. The end surface 243B faces in the second pitch orientation of the pitch direction. The end surface 242B is positioned in the first pitch orientation beyond the end surface 243B. Each of the end surfaces 242B, 243B is a rough, broken face of a base metal plate. In other words, the end surfaces 242B, 243B is not a roll surface of a base metal plate.

As shown in FIG. 21, the upper portion 246B of the present modification extends upward in the up-down direction from the lower portion 245. The upper end 241B is the uppermost end of the upper portion 246B in the up-down direction. The upper portion 246B has two end portions 2462B, 2464B which are positioned at its opposite ends, respectively, in the pitch direction. The end portion 2462B is positioned in the first pitch orientation beyond the end portion 2464B.

As shown in FIG. 21, the end portion 2462B of the upper portion 246B is positioned at a position same as a position of the end portion 2452 of the lower portion 245 in the pitch direction. The end surface 242B of the second portion 240B consists of the end portion 2452 and the end portion 2462B.

As shown in FIG. 22, the end portion 2464B of the upper portion 246B is positioned in the first pitch orientation beyond the end portion 2454 of the lower portion 245. The end portion 2464B of the upper portion 246B is positioned in the first pitch orientation beyond the first portion 260. The end portion 2464B of the upper portion 246B is positioned in the first pitch orientation beyond a wide portion 264. The end portion 2464B of the upper portion 246B is positioned in the first pitch orientation beyond a narrow portion 266.

As shown in FIG. 21, the bent portion 250B of the present modification connects an upper end 261 of the first portion 260 and the upper end 241B of the second portion 240B with each other. The bent portion 250B extends from the upper portion 246B. More specifically, the bent portion 250B extends in the second pitch orientation from the end portion 2464B of the upper portion 246B and is bent to extend inward in the horizontal direction. The bent portion 250B is positioned above the first portion 260 in the up-down direction. The bent portion 250B is positioned above the second portion 240B in the up-down direction.

Figure 23:
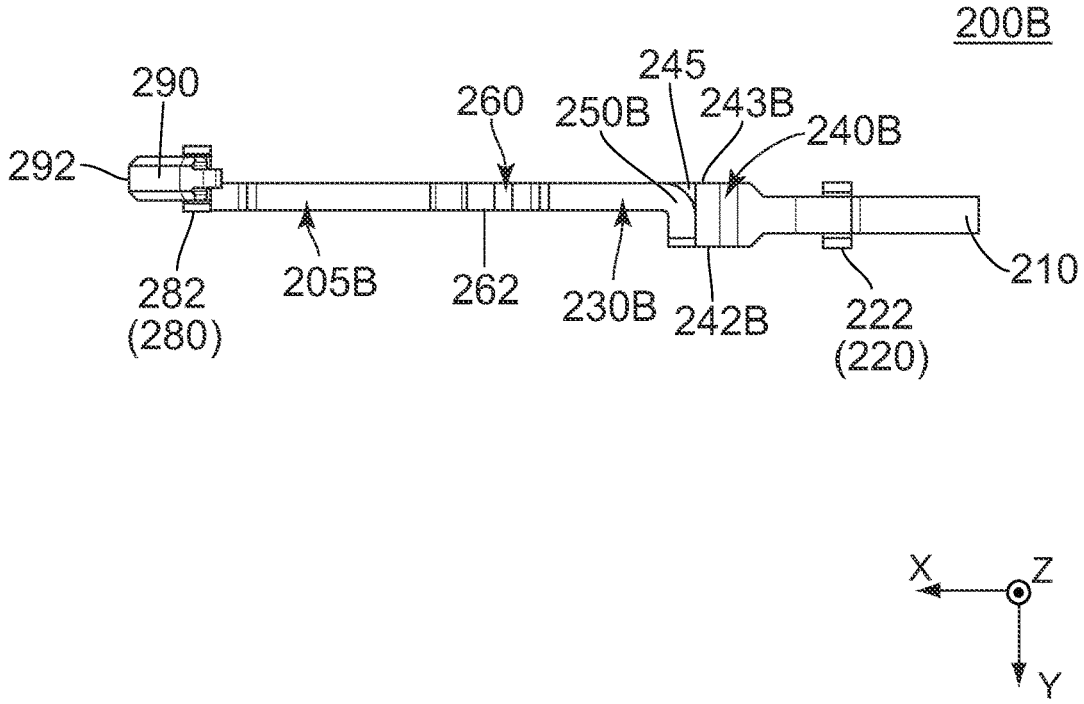
FIG. 23 is a top view showing the contact of FIG. 21.
Figure 24:
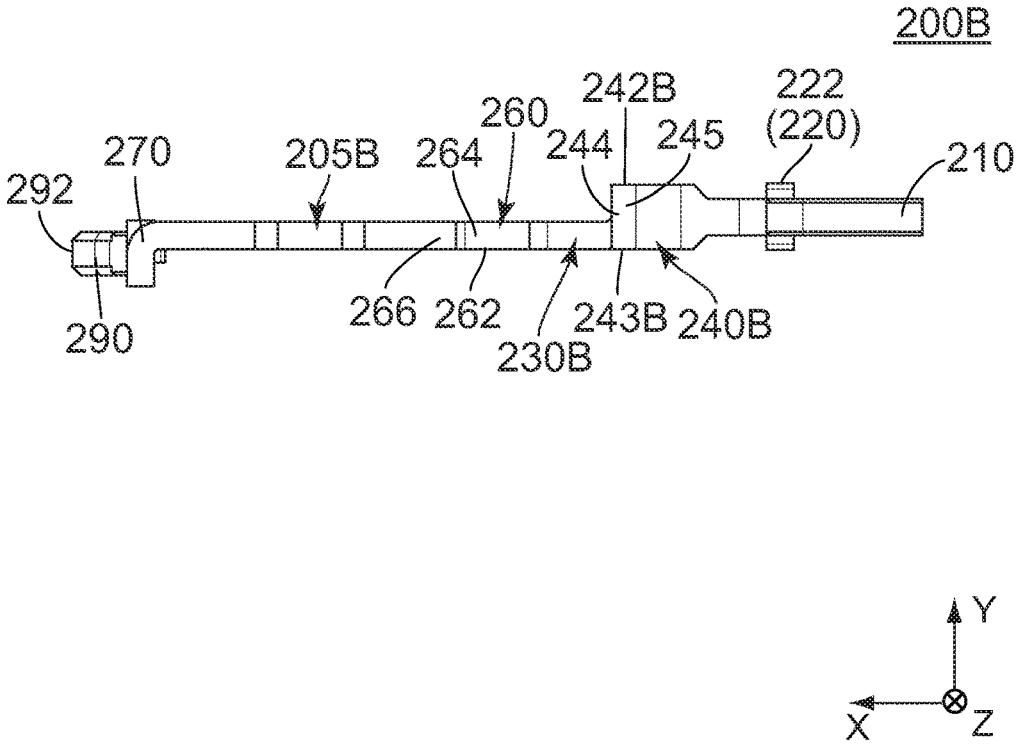
FIG. 24 is a bottom view showing the contact of FIG. 21.

As shown in FIG. 23, the bent portion 250B overlaps with the lower portion 245 when the contact 200B is viewed along the up-down direction. The bent portion 250B is positioned between the end surfaces 242B and 243B of the second portion 240B in the pitch direction. This enables the bent portion 250B to be easily formed by bending a blank. Additionally, this enables a contact row (not shown) of the contacts 200B to have a reduced size in the pitch direction to some extent.

(Third Modification)

Figure 25:
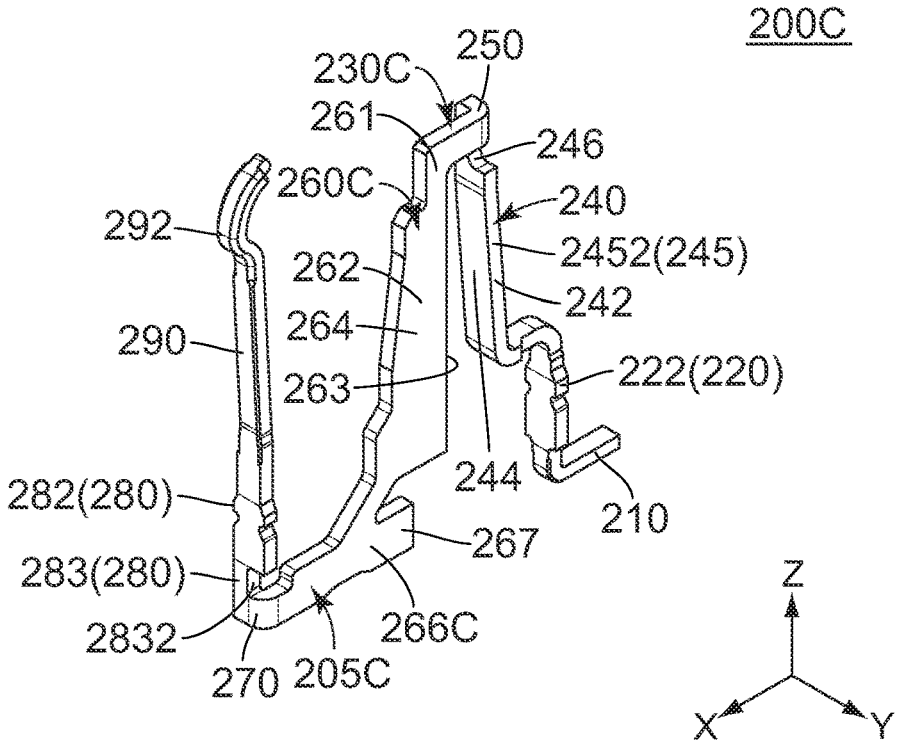
FIG. 25 is an upper, perspective view showing a third modification of the contact of FIG. 7.

Referring to FIG. 25, a contact 200C according to a third modification is made of a single metal plate 205C. The contact 200C is a so-called bent contact. The contact 200C has a fixed portion 210, a regulated portion 220, a held portion 280, an extending portion 290, a contact portion 292 and a coupling portion 230C. Components of the contact 200C other than the coupling portion 230C have structures same as those of the first embodiment. Accordingly, a detailed explanation thereabout is omitted.

Figure 26:
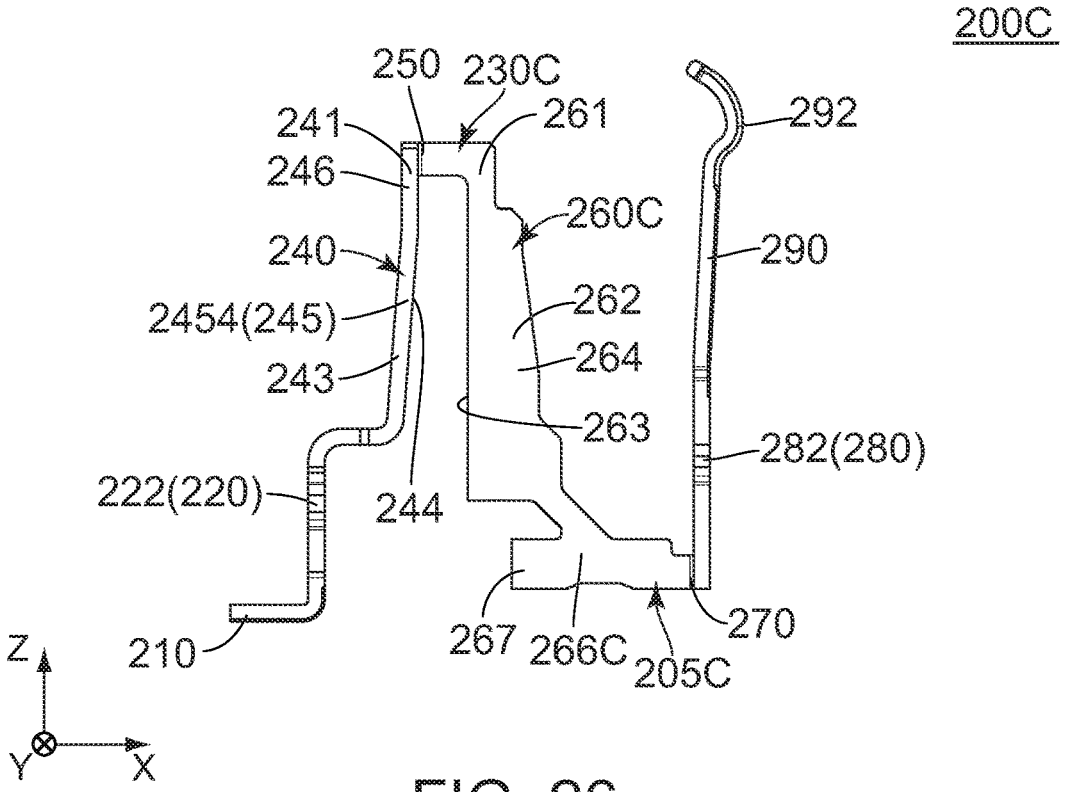
FIG. 26 is a side view showing the contact of FIG. 25.

As shown in FIG. 26, the coupling portion 230C of the present modification couples the regulated portion 220 and the held portion 280 with each other. The coupling portion 230C is resiliently deformable. The coupling portion 230C has a first portion 260C, a second portion 240 and a bent portion 250 which connects the first portion 260C and the second portion 240 with each other. The second portion 240 and the bent portion 250 of the present modification have structures same as those of the second portion 240 and the bent portion 250 of the aforementioned first embodiment. Accordingly, a detailed explanation thereabout is omitted.

As shown in FIG. 26, the first portion 260C of the present modification has a wide portion 264, a narrow portion 266C and a stub protrusion 267. Specifically, the wide portion 264 has a size greater than an average size of the first portion 260C, and the narrow portion 266C has a size smaller than the average size of the first portion 260C. The stub protrusion 267 protrudes from the narrow portion 266C. In other words, the coupling portion 230C further has the stub protrusion 267 which protrudes from the narrow portion 266C. The stub protrusion 267 enables impedance of the first portion 260C to be further adjusted thereat.

Second Embodiment

Figure 27:
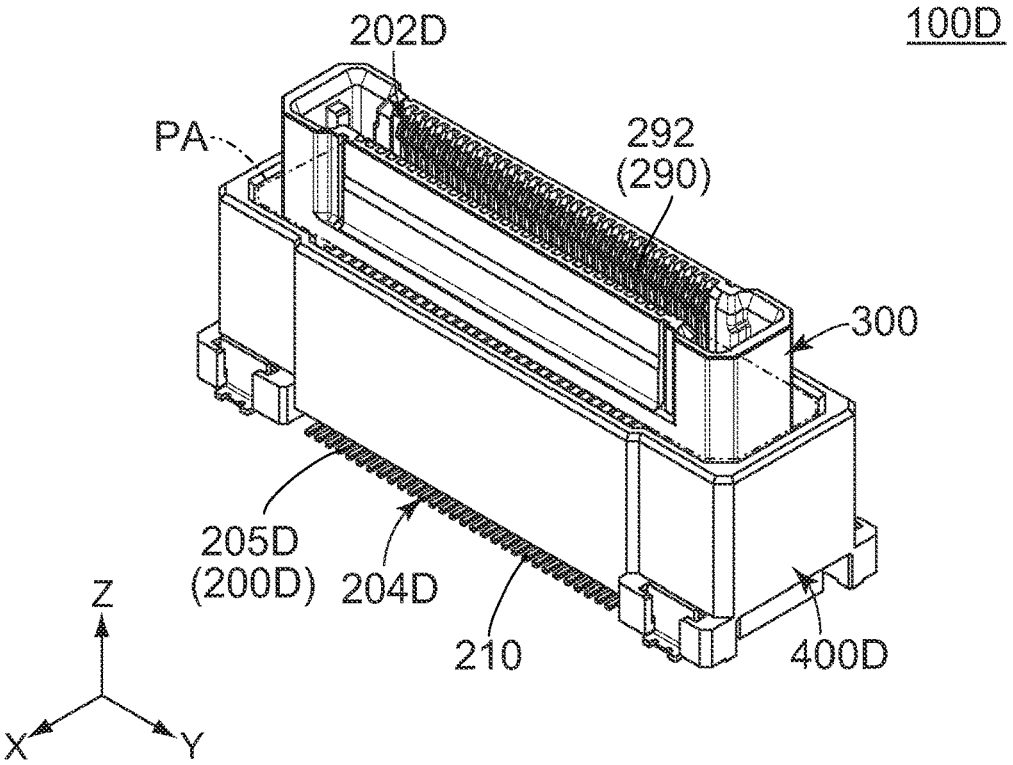
FIG. 27 is a perspective view showing a floating connector which is included in a connector assembly according to a second embodiment of the present invention.
Figure 28:
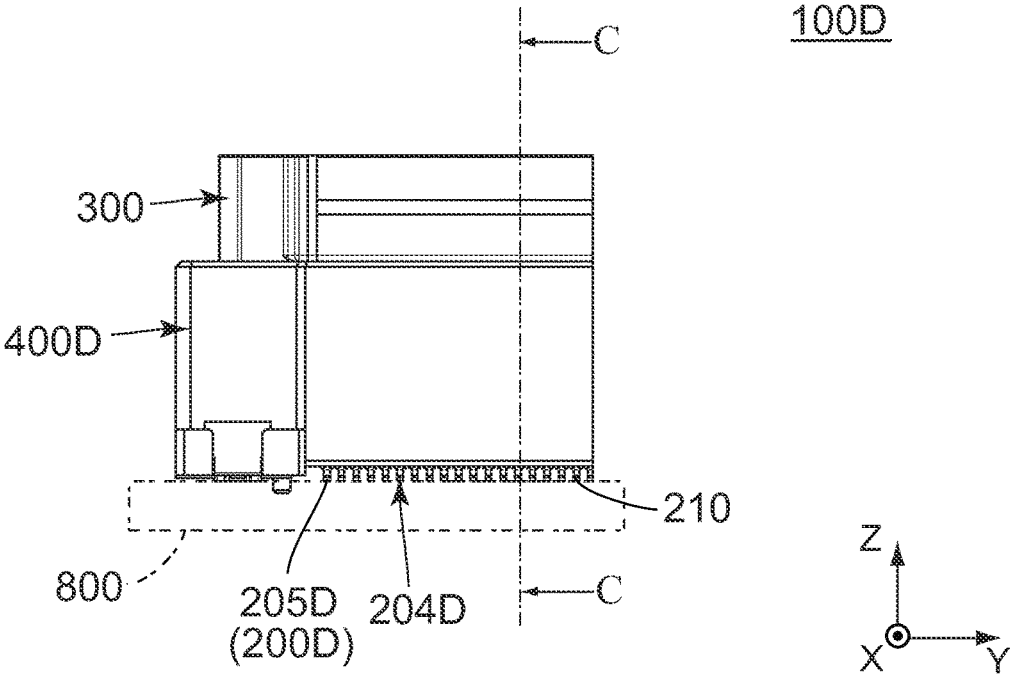
FIG. 28 is a front view showing a part of the floating connector of FIG. 27. In the figure, a circuit board is illustrated by dotted line.

Referring to FIG. 27, a connector assembly (not shown) according to a second embodiment of the present invention comprises a mating connector (not shown) and a floating connector 100D. The mating connector of the present embodiment has a structure similar to that of the mating connector of the aforementioned first embodiment. Accordingly, a detailed explanation thereabout is omitted. As for directions and orientations in the present embodiment, expressions same as those of the first embodiment will be used hereinbelow.

As shown in FIG. 27, the floating connector 100D of the present embodiment has a movable housing 300, a regulating member 400D and a plurality of contacts 200D. The movable housing 300 of the present embodiment has a structure similar to that of the movable housing 300 of the aforementioned first embodiment. Accordingly, a detailed explanation thereabout is omitted.

Figure 29:
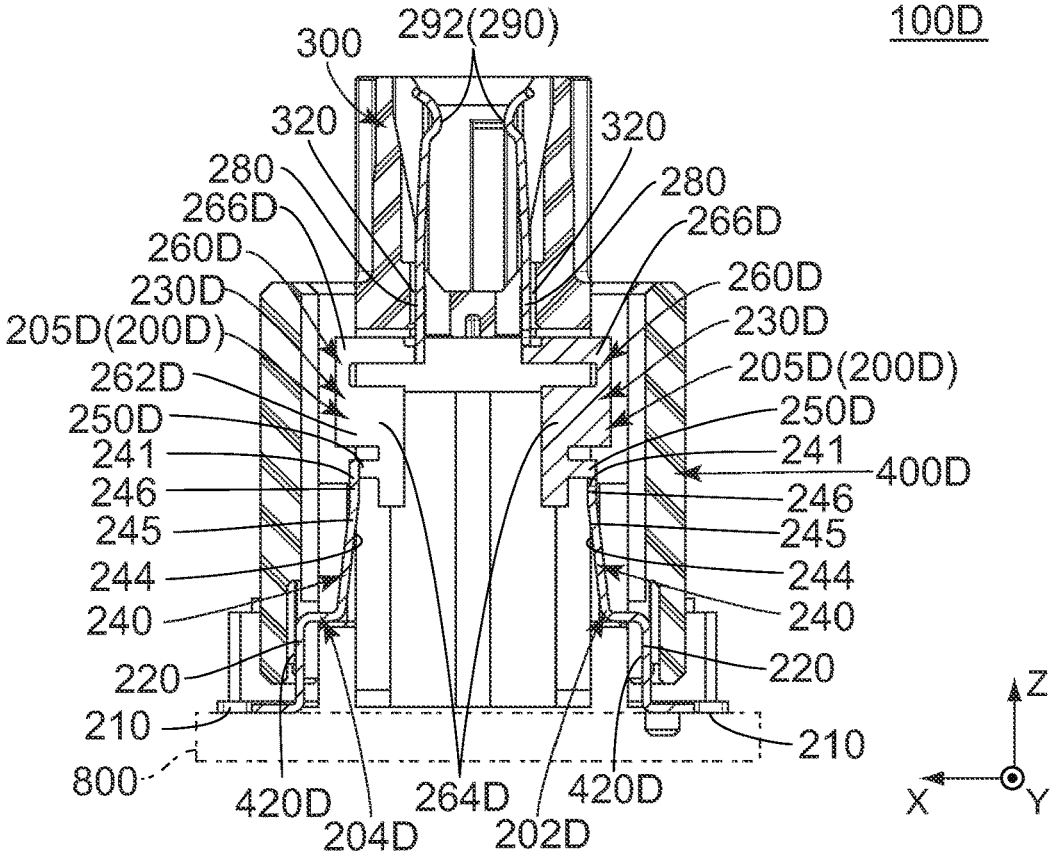
FIG. 29 is a cross-sectional view showing the floating connector of FIG. 28, taken along line C-C. In the figure, the circuit board is illustrated by dotted line.

Referring to FIG. 27, the regulating member 400D of the present embodiment is made of insulator. The regulating member 400D has a substantially rectangular tube shape extending in the up-down direction. As shown in FIG. 29, the regulating member 400D is positioned below the movable housing 300 in the up-down direction. The regulating member 400D has a plurality of regulating portions 420D.

Referring to FIG. 29, the regulating portions 420D of the present embodiment correspond to the contacts 200D, respectively. Each of the regulating portions 420D is a hole piercing the regulating member 400D. Each of the regulating portions 420D is positioned in the vicinity of an outer end of the regulating member 400D in the horizontal direction. Each of the regulating portions 420D has two inner walls each facing inward in the pitch direction.

Figure 30:
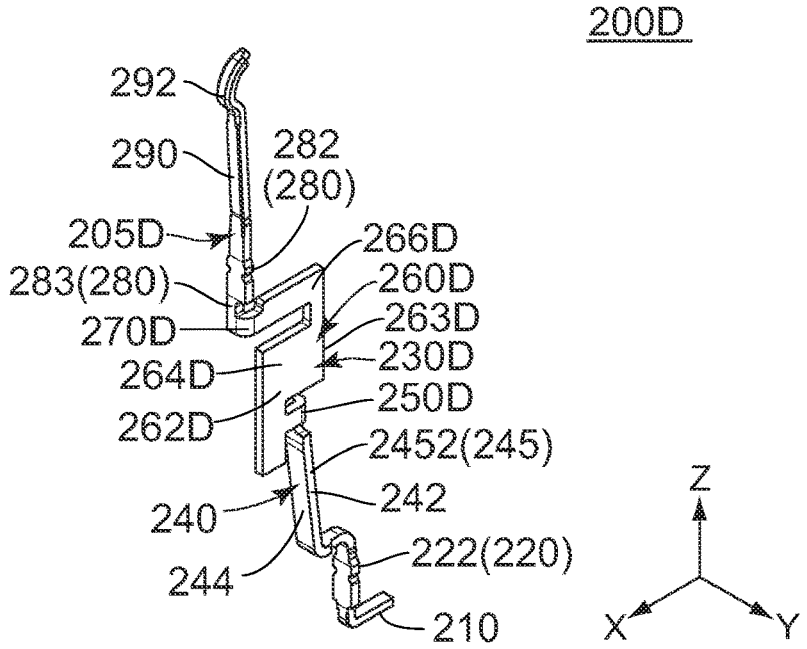
FIG. 30 is an upper, perspective view showing a contact which is included in the floating connector of FIG. 27.

Referring to FIG. 30, each of the contacts 200D of the present embodiment is made of a single metal plate 205D. The contact 200D is a so-called bent contact. Referring to FIG. 29, the contacts 200D form two contact rows 202D, 204D. The two contact rows 202D, 204D are arranged in the horizontal direction. The contacts 200D of each of the contact rows 202D, 204D are arranged in the pitch direction. The contact row 202D is positioned rearward of the contact row 204D in the front-rear direction, or in the horizontal direction.

Hereinafter, explanation will be made about the contact 200D included in the contact row 202D as shown in FIG. 29. The contact 200D, which is included in the contact row 204D as shown in FIG. 29, has a structure same as that of the contact 200D, which is included in the contact row 202D, other than definitions of the first pitch orientation and the second pitch orientation. Accordingly, a detailed explanation thereabout is omitted.

As shown in FIG. 30, the contact 200D of the present embodiment has a fixed portion 210, a regulated portion 220, a held portion 280, an extending portion 290, a contact portion 292 and a coupling portion 230D. Components of the contact 200D other than the coupling portion 230D have structures same as those of the contact 200 of the first embodiment. Accordingly, a detailed explanation thereabout is omitted.

Figure 35:
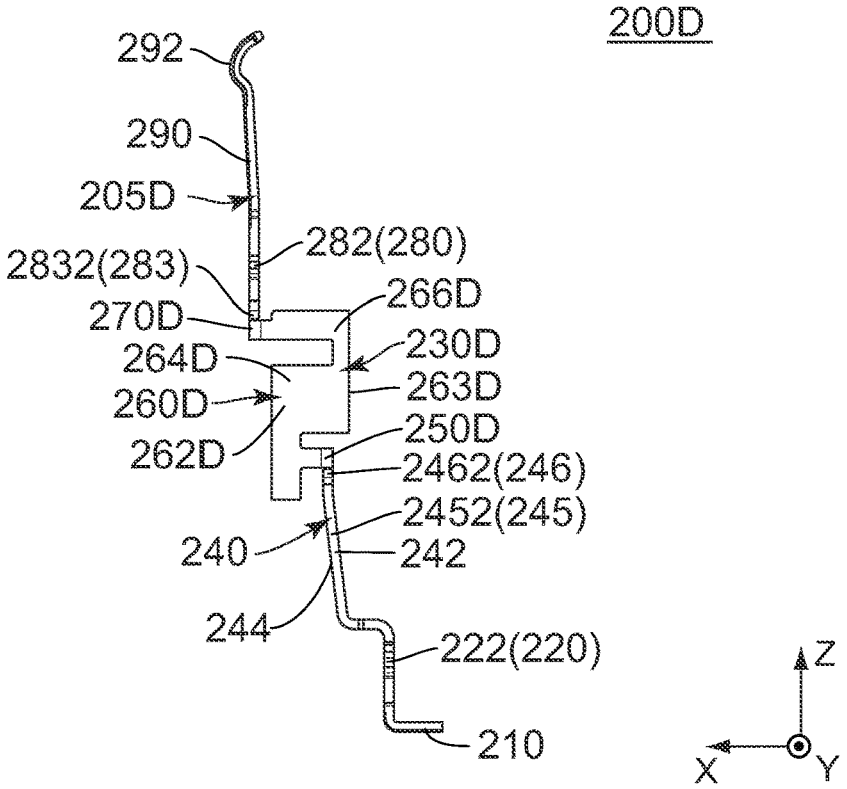
FIG. 35 is a side view showing the contact of FIG. 30.
Figure 36:
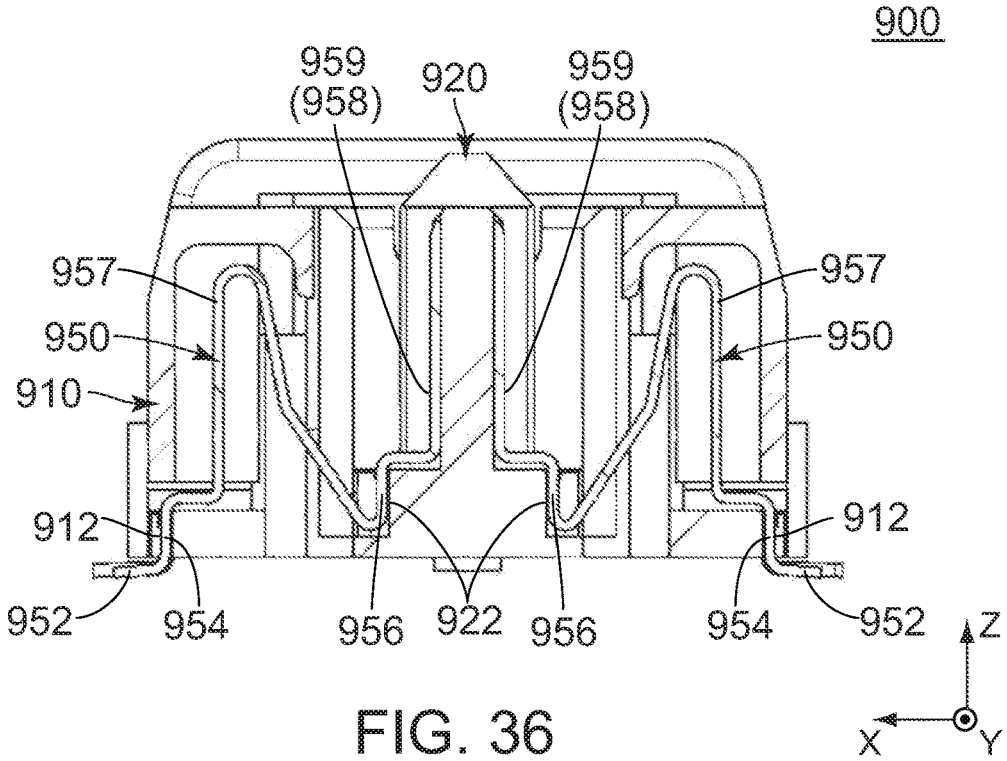
FIG. 36 PRIOR ART
FIG. 36 is a cross-sectional view showing a floating connector of Patent Document 1.
Figure 37:
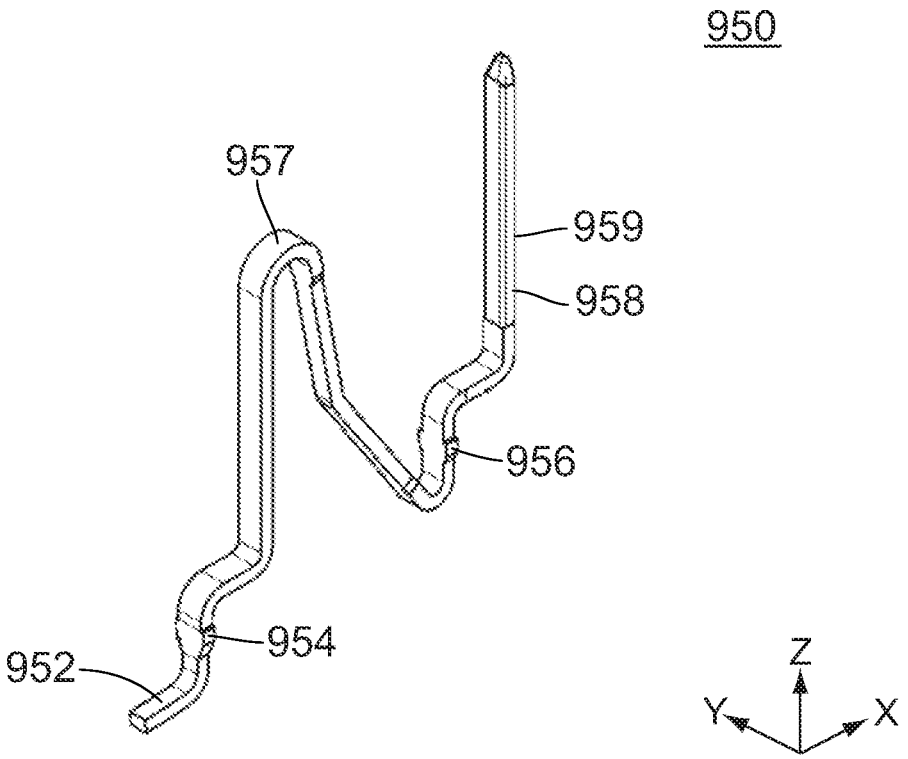
FIG. 37 PRIOR ART
FIG. 37 is a perspective view showing a contact which is included in the floating connector of FIG. 36.

As shown in FIG. 35, the coupling portion 230D of the present embodiment couples the regulated portion 220 and the held portion 280 with each other. As shown in FIG. 29, the coupling portion 230D is positioned below the movable housing 300 in the up-down direction. Referring to FIGS. 27 and 35, the coupling portion 230D is resiliently deformable, and the movable housing 300 is movable within a predetermined range PA in the plane perpendicular to the up-down direction by the resilient deformation of the coupling portion 230D. In other words, the resilient reformation of the coupling portion 230D enables the movable housing 300 not only to be movable in the horizontal direction to some extent but also to be movable in the pitch direction to some extent.

As shown in FIG. 35, the coupling portion 230D of the present embodiment has a first portion 260D, a second portion 240 and a bent portion 250D. Specifically, the bent portion 250D connects the first portion 260D and the second portion 240 with each other. The second portion 240 of the present embodiment has a structure same as that of the second portion 240 of the contact 200 of the first embodiment. Accordingly, a detailed explanation thereabout is omitted.

As shown in FIG. 35, the first portion 260D of the present embodiment is positioned between the held portion 280 and the bent portion 250D. The first portion 260D has a principal surface 262D and an end surface 263D.

As shown in FIG. 35, the principal surface 262D of the present embodiment faces in the pitch direction. In other words, a thickness direction of the principal surface 262D is the pitch direction. The principal surface 262D intersects with the pitch direction. More specifically, the principal surface 262D is perpendicular to the pitch direction. The principal surface 262D is a roll surface of a base metal plate. In other words, the principal surface 262D is not a rough, broken face of a base metal plate.

Figure 32:
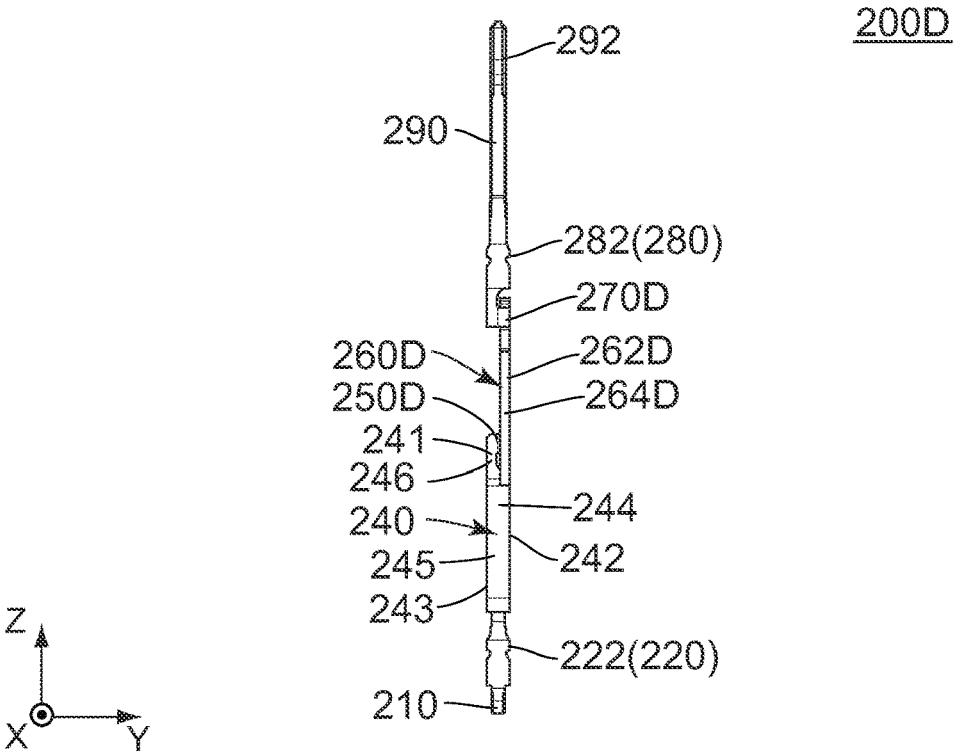
FIG. 32 is a front view showing the contact of FIG. 30.
Figure 33:
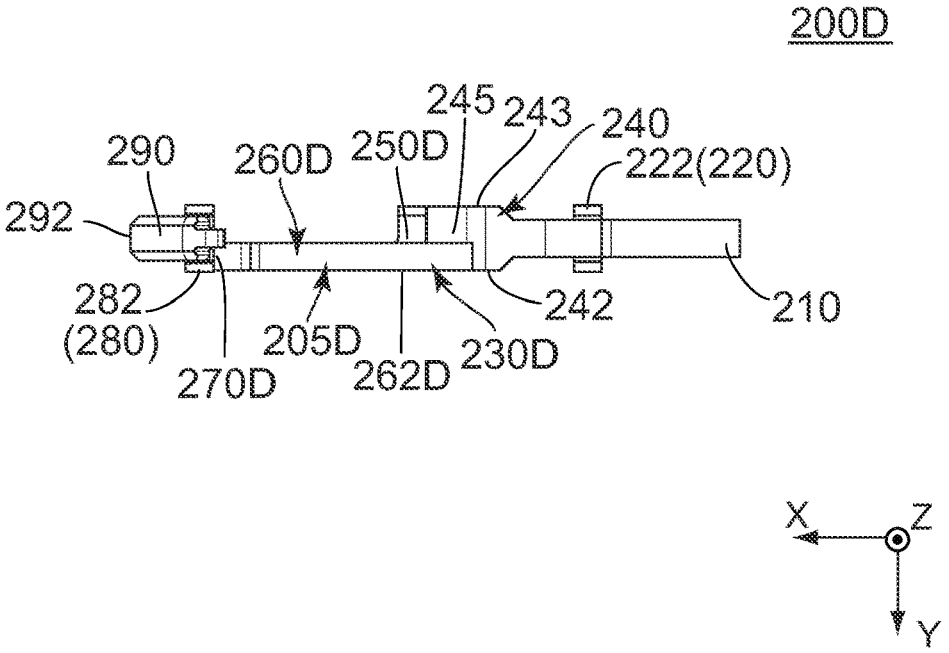
FIG. 33 is a top view showing the contact of FIG. 30.
Figure 34:
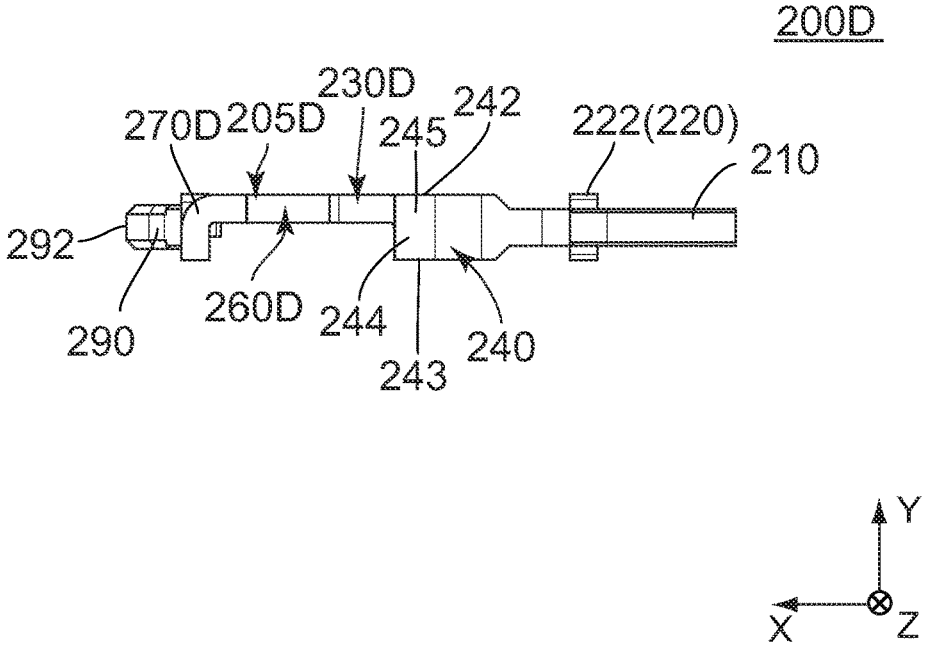
FIG. 34 is a bottom view showing the contact of FIG. 30.

As shown in FIG. 32, the end surface 263D of the present embodiment faces in the horizontal direction. The end surface 263D intersects with the horizontal direction. The end surface 263D is a rough, broken face of a base metal plate. In other words, the end surface 263D is not a roll surface of a base metal plate.

As shown in FIG. 35, the first portion 260D has a narrow portion 266D and a wide portion 264D. Specifically, the narrow portion 266D has a size smaller than an average size of the first portion 260D, and the wide portion 264D has a size greater than the average size of the first portion 260D.

As shown in FIG. 35, the narrow portion 266D of the present embodiment is positioned below the held portion 280 in the up-down direction. The narrow portion 266D is positioned above the wide portion 264D in the up-down direction. The narrow portion 266D extends upward from an upper end of the wide portion 264D. In a plane parallel to the principal surface 262D, the narrow portion 266D has a size smaller than the average size of the first portion 260D.

As shown in FIG. 35, the wide portion 264D of the present embodiment is positioned above the regulated portion 220 in the up-down direction. The wide portion 264D is positioned above the second portion 240 in the up-down direction. The wide portion 264D is positioned above the bent portion 250D in the up-down direction. In the plane parallel to the principal surface 262D, the wide portion 264D has a size greater than the average size of the first portion 260D. Specifically, in the plane parallel to the principal surface 262D, the wide portion 264D is wider than the narrow portion 266D. Accordingly, the wide portion 264D has a reduced impedance in the first portion 260D.

Referring to FIG. 30, the principal surface 262D of the first portion 260D faces in a first direction, and a principal surface 244 of the second portion 240 faces in a second direction. Specifically, the first direction is different from the second direction. In other words, a thickness direction of the first portion 260D is different from a thickness direction of the second portion 240. More specifically, the direction in which the principal surface 262D of the first portion 260D faces is perpendicular to the direction in which the principal surface 244 of the second portion 240 faces. In other words, the thickness direction of the first portion 260D is perpendicular to the thickness direction of the second portion 240. Thus, the floating connector 100D of the present embodiment is configured so that, upon the movement of the movable housing 300, the second portion 240 is resiliently deformed in response to a horizontal directional component of the movement of the movable housing 300 while the first portion 260D is resiliently deformed in response to a pitch directional component of the movement of the movable housing 300. By this configuration, the floating connector 100D of the present embodiment can suppress occurrence of torsional stress in the held portion 280 of the contact 200D even when the movable housing 300 is moved in the pitch direction.

Figure 31:
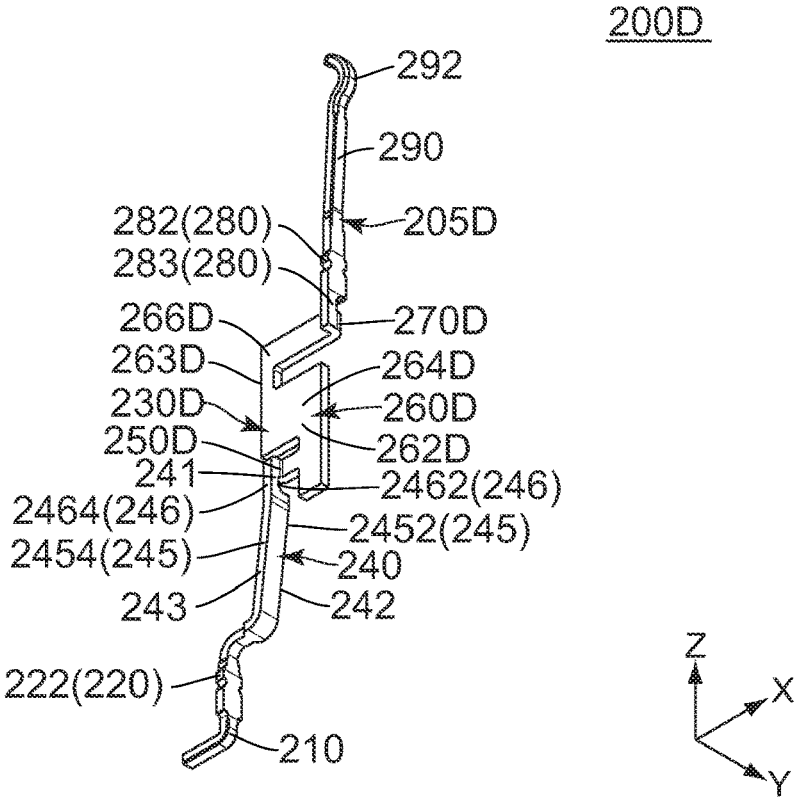
FIG. 31 is a lower, perspective view showing the contact of FIG. 30.

As shown in FIG. 31, the bent portion 250D of the present embodiment connects the first portion 260D and an upper end 241 of the second portion 240 with each other. The bent portion 250D extends from an upper portion 246. In detail, the bent portion 250D extends in the first pitch orientation from an end portion 2462 of the upper portion 246 and is bent to extend inward in the horizontal direction. As shown in FIG. 35, the bent portion 250D is positioned below the first portion 260D in the up-down direction. The bent portion 250D is positioned above the second portion 240D in the up-down direction. As understood from FIGS. 31 and 32, the bent portion 250D overlaps with a lower portion 245 when the contact 200D is viewed along the up-down direction. The bent portion 250D is positioned between end surfaces 242 and 243 of the second portion 240 in the pitch direction. This enables the bent portion 250D to be easily formed by bending a blank. Additionally, this enables the contact row 202D, 204D to have a reduced size in the pitch direction to some extent.

As shown in FIG. 35, the coupling portion 230D of the present embodiment further has an additional bent portion 270D which couples the held portion 280 and the first portion 260D with each other.

As shown in FIG. 30, the additional bent portion 270D of the present embodiment is positioned between the held portion 280 and the first portion 260D. The held portion 280 is positioned between the additional bent portion 270D and the extending portion 290. The additional bent portion 270D couples the held portion 280 and the first portion 260D with each other. The additional bent portion 270D couples a connecting portion 283 and the first portion 260D with each other. The additional bent portion 270D extends outward in the horizontal direction from the first portion 260D and is bent to extend in the second pitch orientation. As shown in FIG. 35, the additional bent portion 270D is positioned below the held portion 280 in the up-down direction. The additional bent portion 270D is positioned at a position same as a position of the narrow portion 266D in the up-down direction. The additional bent portion 270D is positioned above the wide portion 264D in the up-down direction. The additional bent portion 270D is positioned above the bent portion 250D in the up-down direction. The additional bent portion 270D is positioned above the second portion 240 in the up-down direction. The additional bent portion 270D is positioned above the regulated portion 220 in the up-down direction. The additional bent portion 270D is positioned above the fixed portion 210 in the up-down direction.

Although the specific explanation about the present invention is made above referring to the embodiments, the present invention is not limited thereto and is susceptible to various modifications and alternative forms. In addition, the above embodiments and variations may also be combined.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A floating connector mountable on a circuit board, the floating connector being mateable with and separable from a mating connector along an up-down direction, the mating connector having a mating contact portion, and the floating connector comprising:

a movable housing;

a regulating member; and a plurality of contacts, wherein:

the movable housing has a holding portion;

the regulating member has a regulating portion;

each of the contacts comprises a single metal plate;

each of the contacts has a fixed portion, a regulated portion, a held portion, an extending portion, a contact portion, and a coupling portion;

the fixed portion is fixable to the circuit board;

a movement of the regulated portion in a pitch direction perpendicular to the up-down direction is regulated by the regulating portion;

the held portion is held by the holding portion;

the extending portion extends upward in the up-down direction from the held portion;

the contact portion is supported by the extending portion;

the coupling portion couples the regulated portion and the held portion with each other;

the contact portion is brought into contact with the mating contact portion when the floating connector is mated with the mating connector;

the coupling portion is resiliently deformable;

the movable housing is movable within a predetermined range in a plane perpendicular to the up-down direction by resilient deformation of the coupling portion;

the coupling portion has a first portion, a second portion, and a bent portion which connects the first portion and the second portion with each other;

each of the first portion and second portion has a principal surface;

the first portion is positioned between the held portion and the bent portion;

the second portion is positioned between the regulated portion and the bent portion;

the principal surface of the first portion faces in a first direction;

the principal surface of the second portion faces in a second direction;

the first direction and the second direction are different from each other;

the first portion has a wide portion and a narrow portion;

the wide portion has a size greater than an average size of the first portion;

the narrow portion has a size smaller than the average size of the first portion; and the narrow portion is positioned below the wide portion in the up-down direction.

2. The floating connector as recited in claim 1, wherein:

the contact portion has a first size in the pitch direction;

the contact portion has a second size in a horizontal direction perpendicular to both the pitch direction and the up-down direction; and the first size is greater than the second size.

3. The floating connector as recited in claim 2, wherein:

the principal surface of the first portion faces in the pitch direction; and the coupling portion has an additional bent portion which couples the held portion and the first portion with each other.

4. The floating connector as recited in claim 3, wherein the held portion is positioned between the additional bent portion and the extending portion.

5. The floating connector as recited in claim 1, wherein the first direction and the second direction are perpendicular to each other.

6. The floating connector as recited in claim 1, wherein the coupling portion further has a stub protrusion which protrudes from the narrow portion.

7. The floating connector as recited in claim 1, wherein each of the fixed portion, the regulated portion, and the principal surface of the second portion intersects with the horizontal direction.

8. The floating connector as recited in claim 1, wherein;

each of the first portion and the second portion has an upper end in the up-down direction; and the bent portion connects the upper end of the first portion and the upper end of the second portion with each other.

9. The floating connector as recited in claim 1, wherein the extending portion supports the contact portion so that the contact portion is movable.

10. The floating connector as recited in claim 1, wherein:

the second portion has an end surface in the pitch direction;

the bent portion is positioned outward beyond the end surface of the second portion in the pitch direction;

the plurality of contacts form a contact row;

the contacts of the contact row are arranged in the pitch direction; and when the contact row is viewed along the up-down direction, the bent portion of one of two of the contacts, which are adjacent to each other, overlaps with the second portion of a remaining one of the two contacts.

11. The floating connector as recited in claim 1, wherein:

the second portion has opposite end surfaces in the pitch direction;

the bent portion is positioned between the opposite end surfaces of the second portion;

the second portion has a lower portion and an upper portion;

the lower portion has a size greater than an average size of the second portion;

the upper portion has a size smaller than the average size of the second portion;

the upper portion extends upward in the up-down direction from the lower portion;

the bent portion extends from the upper portion; and the bent portion overlaps with the lower portion when the contact is viewed along the up-down direction.

* * * * *